US006035158A

United States Patent [19]

Asakura et al.

[11] Patent Number: 6,035,158

[45] Date of Patent: Mar. 7, 2000

[54] IMAGE FORMING APPARATUS AND BELT UNIT THEREOF

[75] Inventors: Kenji Asakura, Katano; Yasutaka Tamai, Nara Pref.; Keizou Takeuchi, Hirakata; Masanori Yoshikawa, Neyagawa; Noboru Katakabe, Uji; Hiromichi Miyoshi, Utsunomiya, all of Japan

[73] Assignee: Matsushita Electric Industrial Co., Ltd., Osaka-fu, Japan

[21] Appl. No.: 09/198,938

[22] Filed: Nov. 24, 1998

[30] Foreign Application Priority Data

Nov. 28, 1997 [JP] Japan ..... 9-329115
Dec. 10, 1997 [JP] Japan ..... 9-340360

[51] Int. Cl.[7] ..... G03G 15/01

[52] U.S. Cl. ..... 399/101; 399/102; 399/112; 399/123; 399/302

[58] Field of Search ..... 399/101, 102, 399/107, 110, 111, 112, 121, 123, 124, 125, 223, 227, 298, 299, 302, 303, 308, 344, 345, 349, 358; 347/138, 152

[56] References Cited

U.S. PATENT DOCUMENTS

| | | | |
|---|---|---|---|
| 5,107,304 | 4/1992 | Haneda et al. | 399/112 |
| 5,227,851 | 7/1993 | Yoshida et al. | 399/121 X |
| 5,260,754 | 11/1993 | Yano et al. | 399/123 |
| 5,444,522 | 8/1995 | Owens, Jr. | 399/123 |
| 5,479,244 | 12/1995 | Kashihara et al. | 399/175 |
| 5,565,975 | 10/1996 | Kumon et al. | 399/302 |
| 5,612,771 | 3/1997 | Yamamoto et al. | 399/121 X |
| 5,671,464 | 9/1997 | Kubota | 399/101 |
| 5,787,326 | 7/1998 | Ogawa et al. | 399/124 |
| 5,845,174 | 12/1998 | Yasui et al. | 399/101 |

FOREIGN PATENT DOCUMENTS

| | | |
|---|---|---|
| 57-169781 | 10/1982 | Japan . |
| 08286455 | 11/1996 | Japan . |

*Primary Examiner*—Sophia S. Chen
*Attorney, Agent, or Firm*—Akin, Gump, Strauss, Hauer & Feld, L.L.P.

[57] ABSTRACT

A bet unit provides an intermediate transfer belt where primary transfer is performed at a part stretching between a drive roller and a tension roller, and a cleaner roller separated from and brought into contact with a part of the intermediate transfer belt stretching between an opposed roller and the drive roller in the downstream side of the opposed roller. The belt unit is detachably attachable to the body with the opposed roller on the operator's side. The tangential line of the opposed roller is substantially vertical at a secondary transfer position. The cleaner roller is disposed in a range enclosed by the intermediate transfer belt, the tangential line of the drive roller parallel to the common tangential line of the peripheries of the tension roller and the opposed roller, and the vertical tangential line of the secondary transfer side of the opposed roller.

22 Claims, 17 Drawing Sheets

1
2
3
3A
4
5
5A
6
7
20
20A
21
21A
22
23
24
26
26A
26B
29
29BK
29C
29M
29Y
30BK
30C
30M
30Y
31
33
34
35
36
40
41
42
43
44
45
46
47
48
49
50a
50b
50c
50d
51
52
53
54
65
66
67
R

IMAGE FORMING APPARATUS AND BELT UNIT THEREOF

BACKGROUND OF THE INVENTION

The present invention relates to an image forming apparatus applicable to color printers, color copiers and color facsimiles, and more particularly, to a belt unit and a color image forming apparatus having an intermediate transfer belt for superimposing toner images of a plurality of colors and a cleaner for removing residual toner on the intermediate transfer belt.

As an example of conventional color image forming apparatuses, a color electrophotographic apparatus is described in Japanese Laid-open Patent Application No. Hei 8-286455. FIG. 13 is a cross-sectional elevation view electrophotographic apparatus.

In FIG. 13, a belt unit 201 includes a transfer belt 202, a first transfer roller 203, a second transfer roller 204, a backup roller 205 and a guide roller 206. Color images are superimposed on the transfer belt 202 of the belt unit 201. In the left part of FIG. 13, an image forming unit 207 is disposed in which four fan-shaped image forming units 207Bk, 207Y, 207M and 207C for black, yellow, magenta and cyan, respectively, are arranged so as to form a circle. A laser exposure unit 212 is disposed in an upper part of the printer.

By attaching the image forming unit 207 in the printer, a mechanical drive system and an electric circuit system on the printer side are coupled to the image forming unit 207 by a non-illustrated inter-coupling member, so that the image forming unit 207 is mechanically and electrically connected to the printer. The image forming units 207Bk, 207Y, 207M and 207C disposed on a circle are rotated around a fixed mirror 213 by a driving motor (not shown). At the time of image formation, the image forming units 207Bk to 207C are rotated, and successively come to an image formation position 210 opposed to the first transfer roller 203 which supports the intermediate transfer belt 202. The image formation position 210 is also the position of exposure, whereat a photoconductor drum 218 is exposed by a laser beam 211.

The laser beam 211 is made incident through the gap between the image forming units 207Bk and 207C, and reflected at the mirror 213. The reflected laser beam 211 is made incident on an exposure section on the left side surface of the photoconductor drum 218 of the black image forming unit 207Bk, which is situated at the image formation position 210. The laser beam 211 scans in the direction of the generator of the photoconductor drum 218 which direction is vertical to the plane of FIG. 13 and exposes the photoconductor drum 218, so that a latent image is formed. The latent image is developed by a developer unit 219. The toner image developed by the developer unit 219 is transferred onto the transfer belt 202. Then, the image forming unit 207 rotates 90 degrees in the direction of an arrow R, so that the yellow image forming unit 207Y is situated at the image formation position 210 instead of the image forming unit 207Bk. Then, the same operation as that of the above-mentioned black image formation is performed, and the yellow image is formed in a superimposed manner on the black toner image having already been formed on the intermediate transfer belt 202. Similar operations are successively performed by use of the magenta and cyan image forming units 207M and 207C, so that a full color image is completed on the intermediate transfer belt 202. Then, one sheet of recording paper picked up from a paper feed unit (not shown) is conveyed, being timed by a resist roller 214, to a nip part where the intermediate transfer belt 202 and a secondary transfer roller 215 are in contact. The toner images of the four colors superimposed on one another are transferred onto the recording paper at a time, and fixed by a fuser unit 216. The recording paper having undergone fusing is discharged toward the right side of the figure. The toner remaining on the intermediate transfer belt 202 is removed by a cleaner roller 217. To the cleaner roller 217, a positive voltage is applied which is opposite in polarity to the charge applied to the toner. During toner image formation, in order to prevent toner from adhering to the cleaner roller 217, a voltage of a polarity (negative) the same as that of the charge applied to the toner is applied to the cleaner roller 217 which is always pressed against the intermediate transfer belt 202.

Another conventional example, Japanese Laid-open Patent Application No. Sho 57-169781 discloses a cleaner shown in FIG. 14. In FIG. 14, a rigid cleaner backup member 220 held by a spring 224 and a cleaner roller 225 pinch a transfer belt 223 entrained about support rollers 221 and 222 for conveying recording paper. The cleaner backup member 220 is formed so as to be always biased toward the cleaner roller 225 by the spring 224. FIG. 15 is an enlarged view showing the part where the cleaner roller 225 and the transfer belt 223 are in contact.

As still another conventional example, as shown in FIG. 16, there is known structure having a cleaner roller 230 energized with a voltage of inverse polarity to the charge of the toner. The cleaner roller 230 is operated so as to be alternatingly separated from and brought into contact with a semi-conductive intermediate transfer belt 233 which is entrained between support rollers 231 and 232 which are connected to GND potential.

Further, in a cleaner 244 of a transfer belt according to another conventional example shown in the cross-sectional view of FIG. 17, a blade 240 of urethane is pressed against a transfer belt 241, and toner is scraped off by the blade 240. The scraped toner is scooped by a scoop seal 242 so as not to spill through the gap between the transfer belt and a toner case 243, and is collected into the toner case 243. This is known as a cleaning blade method.

Color image forming apparatuses are required not only to improve the throughput and the positioning accuracy for accurately positioning the images of a plurality of colors but also to improve cleaning capability for completely removing unnecessary toner on the intermediate transfer belt.

In the conventional example of FIG. 13, the cleaner roller 217 is always pressed against the intermediate transfer belt 202, and switching between removal and non-removal of toner is made by changing the polarity of the voltage. Even if the toner on the intermediate transfer belt 202 is prevented from being removed by applying to the cleaner roller 217 a voltage which is the same in polarity as the charge applied to the toner, there are cases where toner is removed by a frictional force other than the electric force, and the toner image is liable to be disturbed.

To avoid the above-mentioned defect, a structure in which the cleaner is separated from and brought into contact with the intermediate transfer belt has been put to practical use. In this structure, when cleaning is performed by bringing the cleaner in contact with the intermediate transfer belt after the formation of a color image on the intermediate transfer belt by superimposing toner images of four colors is completed, the length of the belt from the transfer position to the cleaner position must be longer than the length of the image range.

Consequently, the circumferential length of the belt increases, so that the belt unit and the body of the apparatus increase in size. In addition, the time necessary for the belt to rotate once increases, so that the throughput decreases.

In normal color image forming apparatuses, the images of four colors are put together in position and superimposed with each other on the intermediate transfer belt. Therefore, high positioning accuracy is required in order to prevent displacement of positions of the images of respective colors. The positional displacement among the images of the respective colors will hereinafter be referred to as mere "positional displacement."

The accuracies of the rollers about which the intermediate transfer belt 202 is entrained largely affect the positioning accuracy. For this reason, in the conventional example of FIG. 13, the backup roller 205 about which the intermediate transfer belt 202 is entrained is required to have considerable rigidity.

The separation from and contact with the backup roller 205 of the cleaner roller 217 largely vary the load on the intermediate transfer belt 202. When the load acting on the intermediate transfer belt 202 varies due to the separation and contact of the cleaner roller 217, the amount of slip that is steadily and slightly caused between the drive shaft and the intermediate transfer belt 202 varies. Consequently, the transportation speed of the intermediate transfer belt 202 varies between the case where the cleaner roller 217 is separated and the case where the cleaner roller 217 is in contact, so that a positional displacement is caused among the images of the colors on the intermediate transfer belt 202. The greater the load variation is, the larger speed variation due to the separation and contact of the cleaner roller 217 is, and the more conspicuous the positional displacement is. In addition, the load variation due to the separation and contact of the cleaner roller 217 deforms the drive member of the intermediate transfer belt 202. Consequently, a positional displacement is caused between the toner image formed when the cleaner roller 217 is separated and the toner image formed when the roller 217 is in contact.

In the conventional art of FIG. 13, since the belt unit 201 has a low-profile configuration being elongated in the horizontal direction of the figure, the distance between the primary transfer section and the secondary transfer section is long, so that the horizontal length of the body of the apparatus is large. Moreover, the part of the cleaner roller 217 disposed outside the intermediate transfer belt 202 protrudes in the upper right direction of the figure. Further, in order to attach and detach the intermediate transfer belt 201 to and from the body of the apparatus in a slanting direction from the upper right, the opening through which the intermediate transfer belt 201 passes when it is attached and detached is necessarily large. For this reason, a front door 227 for opening and closing the opening includes the fuser unit 216, so that the size and the weight increase.

There is a space on the left of a paper feed mechanism such as the resist roller 214 and below the belt unit 201. Thus, the space in the apparatus is not effectively used and the size of the apparatus increases accordingly. Further, since recording paper whereon fusing is over is discharged toward the right side of the figure (front side of the apparatus), the paper discharge tray (not shown) protrudes rightward, so that the floor area of possession increases.

In the structure of the prior art shown in FIG. 14 in which the rigid cleaner backup member 220 is pressed against the cleaner roller 225 with elasticity, as shown in FIG. 15, the backup member 220 is in contact with the transfer belt 223 only in a range B which is a part of a nip part S of the cleaner roller 225. For this reason, the backup member 220 as an opposed electrode contacts only a part of the nip part S. Consequently, the potential of the semi-conductive transfer belt 223 is unstable at the contact part of the nip part S because of potential variation of the adjoining belt support shaft and movement of charges from the cleaner roller 225. This weakens the force of the electric field that moves toner from the transfer belt 223 to the cleaner roller 225, so that the cleaning capability is deteriorated.

In the prior art shown in FIG. 14 and FIG. 15, W represents the region of encroachment of the cleaner roller 225 on a common tangential line P of the rollers 221 and 222 about which the transfer belt 223 is entrained. The backup member 220 cannot push the transfer belt 223 against the cleaner roller 225 in the entire encroachment region W. The transfer belt 223 and the cleaner roller 225 contact only in the range of the nip part S in the vicinity of the central part. Since the nip part S is narrow, the contact between the cleaner roller 225 and the transfer belt 223 is unstable because of depressions or deformation of the surface of the cleaner roller 225. Consequently, the frictional force and the electric field force affecting to the toner on the transfer belt 223 weaken, so that the cleaning capability is deteriorated.

In the prior art shown in FIG. 16, the cleaner roller 230 is energized with a voltage of inverse polarity to the charge of the toner. The cleaner roller 230 is operated so as to be alternatingly separated from and brought into contact with the semi-conductive intermediate transfer belt 233 which is entrained between the support rollers 231 and 232. Since an opposed electrode like the backup member 220 in FIG. 15 is absent, the potential of the semi-conductive intermediate transfer belt 233 is unstable in the nip part because of movement of charges from the cleaner roller 230 and other high-potential members. Consequently, the electric field force that moves toner from the intermediate transfer belt 233 to the cleaner roller 230 weakens, so that the cleaning capability is deteriorated. When the potential of the adjoining roller is not the GND potential, the potential of the intermediate transfer belt 233 at the cleaning position is particularly unstable because it is dependent on the electrical resistance and the thickness of the intermediate transfer belt 233.

In the cleaning blade method of the prior art shown in FIG. 17, when the blade 240 is separated from the intermediate transfer belt 241, the inside of the toner case 243 communicates with the outside between an end of the blade 240 and the scoop seal 242. At this time, the toner collected into the toner case 243 by cleaning spills and contaminates the inside of the apparatus. Further, when only a cleaner 244 is taken out of the apparatus with the toner case 243 being filled with toner, toner spills inside and outside the apparatus.

Thus, in the cleaning blade method, if the cleaning surface of the intermediate transfer belt 241 inclines upward from the vertical even slightly, when the blade 240 is separated from the intermediate transfer belt 241, the toner that heaps up at the end of the blade 240 drops onto the intermediate transfer belt 241, so that the intermediate transfer belt 241 and the inside of the apparatus are contaminated. For this reason, an upward-facing surface cannot be used as the cleaning surface.

A conventional belt unit drive mechanism is structured so that when the belt unit is attached, the drive roller for rotating the intermediate transfer belt and the drive system on the body side relatively move in the direction of axis of the drive roller and engage with each other. In this structure, for example, it is necessary to insert and take out a drive coupler after the belt unit is attached, and a mechanism therefor is necessary. In a structure in which a drive gear is fixed to the drive roller and disposed in the rear of the belt unit in the attachment direction, it is necessary to provide in the belt unit a relief for avoiding interference with the body-side gear when the belt unit is attached. Because of this, the volume of possession of the belt unit cannot be effectively used, so that the belt unit increases in size and the body of the apparatus also increases in size.

In a conventional belt unit positioning mechanism, a positioning mechanism is disposed in the rear of the belt unit in the attachment direction. In this structure, the attitude of the belt unit on the front side in the attachment direction is unstable, so that it is difficult to insert the belt unit in the normal position when it is attached. When the positioning mechanism and the drive gear are separated from each other, it is difficult to ensure the position accuracy of the body-side gear and the drive gear of the belt unit.

When the pressure is too high at the nip part of the secondary transfer section, the toner inside the edge part of the image is not transferred to recording paper, that is, an inner part of the image is missing. To prevent this, the secondary transfer roller is pressed against the intermediate transfer belt at a constant pressure.

In the above-mentioned conventional structure, the recording paper conveyance path is bent at the secondary transfer position, so that the angle of the recording paper on the side of the secondary transfer roller 215 is smaller than 180 degrees. Therefore, when the secondary transfer roller 215 is pressed against the intermediate transfer belt 202 at a constant pressure, the pressure at the nip part of the secondary transfer section varies due to variation in tension of the recording paper, so that nonuniformity in transfer is caused.

When the recording paper conveyance direction is not vertical at the secondary transfer position, the paper conveyance path is complicated, so that the number of elements such as a paper guide increases. This increases the weight of the front door 227 being opened for paper processing such as removal of jammed paper. As a result, the size of the apparatus increases.

When a tension roller is used, the larger the angle at which the recording paper is turned along the tension roller is, the higher the pressure applied to the tension roller is. When the pressure is high, the frictional force at a moving part of the tension roller is large. This hinders smooth movement, so that the intermediate transfer belt is hindered from being transported with stability.

In order to prevent the positional displacement due to variation in circumferential speeds of the photoconductor drum 218 and the intermediate transfer belt 202, it is necessary to synchronize the rotations of the photoconductor drum 218 and the intermediate transfer belt 202. To do so, a structure is used in which the rotations are synchronized by setting the rotation ratio between the intermediate transfer belt 202 and a drive roller to an integer, and the photoconductor drum 218 and a belt drive shaft are rotated by a series of drive system. Although the drive roller is not specified in the above-mentioned conventional example, when the drive roller is situated away from the photoconductor onto which the primary transfer is performed, it is difficult to form the drive shaft of the photoconductor drum 218 and the belt drive shaft as a series of drive system.

BRIEF SUMMARY OF THE INVENTION

An object of the present invention is to provide a color image forming apparatus having a cleaner capable of completely removing unnecessary toner on the intermediate transfer belt with a simple structure without deterioration of the throughput and the positioning accuracy.

Another object of the present invention is to provide a color image forming apparatus capable of preventing toner from spilling inside and outside the color image forming apparatus when waste toner is discharged outside the apparatus.

Still another object of the present invention is to provide a color image forming apparatus realizing all of improvement in positioning accuracy on the intermediate transfer belt, size reduction of the apparatus, improvement of image quality, improvement of the throughput, and easy maintenance.

A color image forming apparatus according to the present invention comprises a conductive transfer belt onto which a toner image is transferred, and a cleaner roller being held at a potential opposite in polarity to a charge applied to toner and being brought into contact with the transfer belt for removing toner on the transfer belt. The color image forming apparatus further comprises collection means for removing toner from the cleaner roller, and an opposed electrode comprising a member being held at a potential closer in polarity to the charge of the toner than a potential of the cleaner roller, being brought into contact with the transfer belt so as to be opposed to the cleaner roller, and having flexibility.

According to the color image forming apparatus, by pressing the flexible opposed electrode having elasticity against the transfer belt, a wide nip part can be surely obtained at the cleaning position. At the same time, the electric field for cleaning can be stably formed in the entire nip part. Consequently, since appropriate frictional force and electric field force affect to toner on the transfer belt, a sufficient cleaning effect is obtained, so that unnecessary toner can be completely removed. Moreover, the reaction caused when the cleaner roller is pressed is reduced, so that the frictional force at the cleaning section can be reduced. Consequently, the transportation of the transfer belt can be stabilized.

A color image forming apparatus according to another aspect of the present invention comprises a semi-conductive intermediate transfer belt onto which charged toner images of a plurality of colors are transferred being superimposed, a plurality of belt support shafts about which the intermediate transfer belt is rotatably entrained, and a cleaner roller being held at a potential opposite in polarity to a charge applied to toner, and being brought into contact with the intermediate transfer belt for removing toner on the intermediate transfer belt. The color image forming apparatus further comprises collection means for removing toner from the cleaner roller, separation and contact means for separating and bringing into contact the cleaner roller from and with the intermediate transfer belt, and an opposed electrode comprising a flexible member being held at a potential closer in polarity to the charge of the toner than a potential of the cleaner roller, being brought into contact with the intermediate transfer belt so as to be opposed to the cleaner roller.

According to the color image forming apparatus, by pressing the flexible opposed electrode having elasticity against the intermediate transfer belt, the nip part for cleaning can be surely set so as to be wide. At the same time, the electric field for cleaning can be stably formed in the entire nip part. Consequently, appropriate frictional force and electric field force affect to toner on the intermediate transfer belt, a sufficient cleaning effect is obtained, and unnecessary toner can be completely removed. Moreover, the reaction caused when the cleaner roller is pressed is reduced, so that the frictional force at the cleaning section can be reduced. Consequently, variation in load imposed on the intermediate transfer belt is reduced, so that the positional displacement of the toner images can be prevented.

In the color image forming apparatus of the present invention, it is desirable to perform the separation and contact of the cleaner roller during transferring operation of the toner image onto the intermediate transfer belt. Thereby, primary transfer and cleaning can be simultaneously performed, so that the image throughput can be improved.

It is desirable to use a conductive brush for the opposed electrode. Thereby, the pressure and the frictional force of the cleaner roller imposed on the intermediate transfer roller can be surely reduced. Consequently, variation in load imposed on the intermediate transfer belt is reduced, so that the positional displacement of the toner images can be prevented.

Further, it is desirable that the opposed electrode be a sheet-form member and that a backup member for pressing the opposed electrode against the intermediate transfer belt with elasticity be provided.

According to this structure, the pressure and the frictional force of the cleaner roller imposed on the intermediate transfer roller can be surely reduced. Consequently, variation in load imposed on the intermediate transfer belt is reduced, so that the positional displacement can be prevented.

It is desirable that the cleaner roller be a roller having a hair-planted brush. According to this structure, the pressure and the frictional force of the cleaner roller imposed on the intermediate transfer belt can be surely reduced. Consequently, variation in load imposed on the intermediate transfer belt is reduced, so that the positional displacement can be prevented.

Further, it is desirable that the cleaner roller be a roller of a conductive material having a high-resistance layer on its surface. Thereby, stable effects can be realized inexpensively with a simple structure. It is the most desirable that the cleaner roller be an aluminum roller having an alumite layer on its surface. Thereby, stable effects can be realized inexpensively with a simple structure.

It is desirable that the potential of the opposed electrode be the ground potential. According to this structure, no power source is necessary for the opposed electrode, so that stable effects can be realized inexpensively with a simple structure.

It is desirable that the potentials of two belt support shafts adjacent to a cleaning position where the cleaner roller is pressed against the intermediate transfer belt be different from each other.

Moreover, it is desirable that a waste toner case for storing toner removed by the cleaner roller be provided and that the intermediate transfer belt, the support shafts, the opposed electrode, the backup member, the cleaner roller, the collection means and the waste toner case be formed as one belt unit. The belt unit is formed so as to be detachably attachable to an apparatus body.

A color image forming apparatus according to another aspect of the present invention comprises a cleaner roller being held at a potential opposite in polarity to a charge applied to toner and having elasticity, removing toner on a semi-conductive intermediate transfer belt onto which toner images of a plurality of colors are successively transferred and superimposed, and a collection roller being pressed against the cleaner roller, having a higher potential than the cleaner roller, and removing toner from the cleaner roller. The color image forming apparatus further comprises a scraper being pressed against the collection roller and scraping toner, a waste toner case for storing toner removed from the collection roller, and a seal member for preventing toner from spilling through a gap between the collection roller and the scraper or between the collection roller and the waste toner case. A cleaner unit having the cleaner roller, the collection roller, the scraper, the waste toner case and the seal member in one unit is formed so as to be detachably attachable to the apparatus body from a direction vertical to the axis of the cleaner roller.

In the above-mentioned color image forming apparatus, since only the cleaner unit is detachably attachable to the color image forming apparatus, the waste toner can be discharged outside the apparatus without spilling. Since the cleaner roller is not replaced, the running cost can be reduced. Since the cleaner unit can be detached and attached from the front of the apparatus in a direction vertical to the cleaner roller axis, maintainability is excellent.

A color image forming apparatus according to yet another aspect of the present invention comprises a cleaner roller being held at a potential opposite in polarity to a charge applied to toner and having elasticity, removing toner on a semi-conductive intermediate transfer belt onto which toner images of a plurality of colors are successively transferred and superimposed, and a collection roller being pressed against the cleaner roller, having a higher potential than the cleaner roller, and removing toner from the cleaner roller. The color image forming apparatus further comprises a scraper being pressed against the collection roller and scraping toner, a waste toner case for storing toner removed from the collection roller, and a seal member for preventing toner from spilling through a gap between the collection roller, and the scraper and the waste toner case. A waste toner unit having the collection roller, the scraper, the waste toner case and the seal member in one unit is formed so as to be detachably attachable to the apparatus body from a direction vertical to the axis of the cleaner roller.

In the above-mentioned color image forming apparatus, since only the cleaner unit is detachably attachable to the color image forming apparatus, the waste toner can be discharged outside the apparatus without spilling. Since the cleaner roller is not replaced, the running cost can be reduced. Since the cleaner unit can be detached and attached from the front of the apparatus in a direction vertical to the cleaner roller axis, maintainability is excellent.

A color image forming apparatus according to still another aspect of the present invention comprises a cleaner roller made of metal and removing toner on a semi-conductive intermediate transfer belt, a scraper being pressed against the cleaner roller and scraping toner, a waste toner case for storing toner removing from the cleaner roller, and a seal member for preventing toner from spilling through a gap between the cleaner roller, and the scraper and the waste toner case. A cleaner unit having the cleaner roller, the scraper, the waste toner case and the seal member in one unit is formed so as to be detachably attachable to the apparatus body from a direction vertical to an axis of the cleaner roller.

In the above-mentioned color image forming apparatus, since only the cleaner unit is detachably attachable to the color image forming apparatus, the waste toner can be discharged outside the apparatus without spilling. Since the cleaner roller is not replaced, the running cost can be reduced. Since the cleaner unit can be detached and attached from the front of the apparatus in a direction vertical to the cleaner roller axis, maintainability is excellent.

A color image forming apparatus according to still another aspect of the present invention comprises an intermediate transfer belt, a first support shaft, a second support shaft and a third support shaft about which the intermediate transfer belt is entrained, and a cleaner roller being separated from and brought into contact with the intermediate transfer belt at a part of the intermediate transfer belt stretching between the first support shaft and the third support shaft, and removing toner when being pressed against the intermediate transfer belt. A part of the intermediate transfer belt stretching between the first support shaft and the second support shaft is a primary transfer position where primary transfer is performed. The intermediate transfer belt, the first to the third support shafts and the cleaner roller are formed as one belt unit so as to be detachably attachable in the color image forming apparatus. The cleaner roller is disposed so that its center is situated within a range enclosed by the intermediate transfer belt, the tangential line of the first support shaft parallel to the common tangential line of the peripheries of the second support shaft and the third support shaft, and the tangential line of the third support shaft parallel to the common tangential line of the peripheries of the first support shaft and the second support shaft.

According to this color image forming apparatus, the belt unit has a substantially parallelogrammatic shape without any extreme projections and depressions, so that the volume of possession in the apparatus body is reduced. Consequently, the size of the opening necessary for attachment and detachment of the belt unit can be minimizd so that the size of the apparatus body can be reduced.

A color image forming apparatus according to still another aspect of the present invention comprises an intermediate transfer belt, three support shafts about which the intermediate transfer belt is entrained, and a cleaner roller being separated from and brought into contact with the intermediate transfer belt, and removing toner when being pressed against the intermediate transfer belt. The three support rollers are a tension roller for maintaining tension of the intermediate transfer belt constant, an opposed roller for secondary transfer and a drive roller for rotating the intermediate transfer belt. Primary transfer is performed at a part of the intermediate transfer belt stretching between the drive roller and the tension roller. Cleaning is performed at a part of the intermediate transfer belt stretching between the opposed roller and the support shaft adjoining the opposed roller in the downstream side. The intermediate transfer belt, the belt support shafts and the cleaner roller are formed as one belt unit so as to be detachably attachable to the apparatus body with the opposed roller on the operator's side. The tangential line of the opposed roller is substantially vertical at the position where secondary transfer is performed. The cleaner roller is disposed in a range enclosed by the intermediate transfer belt, the tangential line of the drive roller parallel to the common tangential line of the outsides of the tension roller and the opposed roller, and the tangential line of the opposed roller at a secondary transfer position.

According to this color image forming apparatus, the belt unit has a substantially parallelogrammatic shape without any extreme projections and depressions, so that the volume of possession in the apparatus body is reduced. Consequently, the size of the opening necessary for attachment and detachment of the belt unit can be minimized, so that the size of the apparatus body can be reduced. Since the path of the recording paper is vertical at the secondary transfer position, the structure is simplified, and the number of elements disposed farther forward than the recording paper path in the apparatus is reduced. Consequently, the apparatus body and the part opened for removing jammed paper can be reduced in weight and size. Further, since the drive shaft of the apparatus body and the photoconductor are close to each other, the structure of the drive system is simplified.

It is desirable that the transfer surface of the intermediate transfer belt against which the cleaner roller is pressed face upward. According to the desirable example, since the recording paper is conveyed upward at the secondary transfer position and the recording paper path takes the shortest route from the bottom to the top of the apparatus, so that the probability of paper jam is reduced. The cleaning position can be set in the downstream side of the secondary transfer position and in the upstream side of the primary transfer position. Consequently, the direction of rotation of the intermediate transfer belt coincides with the order of arrangement of the process steps, so that the deterioration of the throughput can be prevented. The paper feed unit can be disposed at the bottom of the apparatus, and the sheets of recording paper on which images have been recorded can be stored face down on the top surface of the apparatus. As a result, the apparatus can be reduced in size.

It is desirable that the direction of attachment and detachment of the belt unit be parallel to the common tangential line of the second support shaft and the third support shaft. Thereby, since the belt unit is detached and attached in a direction along the two parallel surfaces of the belt unit, the size of the opening necessary for the detachment and attachment can be minimized, so that the size of the apparatus body can be reduced.

It is desirable that the common tangential line of the peripheries of the second support shaft and the third support shaft be substantially horizontal. According to the desirable example, the belt unit can be detached and attached in the horizontal direction from the front surface of the apparatus. The position of the fuser unit situated above the belt unit can be lowered, and the belt unit can be detached and attached without the fuser unit being moved. Consequently, the height of the apparatus can be reduced, and when the belt unit is detached and attached, it is only necessary to open and close a lightweight opening and closing unit with the heavy fuser unit being fixed. Since the fuser unit can be disposed in a front part of the apparatus, the front length of the paper discharge tray that is necessarily as long as the recording sheet can be reduced, so that the size of the apparatus body can be reduced in the front-to-rear direction.

A color image forming apparatus according to still another aspect of the present invention comprises an intermediate transfer belt, cleaning means for removing residual toner on the intermediate transfer belt, and three belt support shafts about which the intermediate transfer roller is entrained. The three belt support rollers are a tension roller for maintaining tension of the intermediate transfer belt constant, an opposed roller for secondary transfer and a drive roller for rotating the intermediate transfer belt. The intermediate transfer belt, the belt support shafts and the cleaning means are formed as one belt unit so as to be detachably attachable with the opposed roller on the operator's side. Primary transfer is performed at a part of the intermediate transfer belt stretching between the drive roller and the tension roller. Cleaning is performed at a part of the intermediate transfer belt stretching between the opposed roller and the support shaft adjoining the opposed roller in the downstream side. The surface of the intermediate transfer inclines upward from the vertical at the cleaning position. The cleaning means is a cleaner roller being separated from and brought into contact with the intermediate transfer belt, and removing toner when pressed against the intermediate transfer belt.

In the structures according to the above-mentioned aspects, the following are further provided: conveying means for conveying waste toner collected by the cleaning means inside the intermediate transfer belt of the belt unit, and a waste toner case provided inside the intermediate transfer belt for storing the waste toner. According to this structure, since the belt unit has no extreme projections and depressions, the size of the opening necessary for attachment and detachment of the belt unit can be minimized, so that the size of the apparatus body can be reduced. By disposing the waste toner case inside the intermediate transfer belt, a large quantity of waste toner can be stored in the belt unit of a comparatively small size. Since the waste toner can also be taken out of the apparatus when the belt is replaced, maintenance can be easily performed without the inside of the apparatus being contaminated by the waste toner.

It is desirable that the direction of attachment and detachment of the belt unit be parallel to the common tangential line of the opposed roller and the support roller adjoining the opposed roller in the upstream side. According to the desirable example, since the belt unit is detached and attached in a direction along the two parallel surfaces of the belt unit, the size of the opening necessary for the detachment and attachment can be minimized, so that the size of the apparatus body can be reduced.

It is desirable that the common tangential line of the peripheries of the opposed roller and the support shaft adjoining the opposed roller in the upstream side be substantially horizontal. According to the desirable example, the belt unit can be detached and attached in the horizontal direction from the front surface of the apparatus. The position of the fuser unit situated above the belt unit can be lowered, and the belt unit can be detached and attached without moving the fuser unit. Consequently, the height of the apparatus can be reduced, and when the belt unit is detached and attached, it is only necessary to open and close a lightweight opening and closing unit in the state that the heavy fuser unit is fixed in the apparatus. Since the fuser unit can be disposed in a front part of the apparatus, the front length of the paper discharge tray that is necessarily as long as the recording sheet can be reduced, so that the size of the apparatus body can be reduced in the front-to-rear direction.

It is desirable that the angle at which the intermediate transfer belt is turned along the drive roller is larger than the angle at which the intermediate transfer belt is turned along the tension roller. According to the desirable example, since the frictional force for supplying a drive force to the intermediate transfer belt is increased, speed variation brought about by load variation due to the separation and contact of the cleaning means is reduced, so that the positional displacement of the images can be restrained. By reducing the angle at which the intermediate transfer belt is turned along the tension roller, the pressure which the tension roller supplies to the intermediate transfer belt can be reduced, so that the tension roller is moved smoothly.

It is desirable that the drive roller have a drive gear meshing with a body gear of the apparatus body and that the drive roller be situated farther forward than the cleaner roller when the belt unit is attached to the apparatus body. According to this desirable example, it is unnecessary to provide in the belt unit a clearance for avoiding interference with the body-side drive member when the belt unit is moved for attachment. No projections and depressions are caused on the belt unit, so that the volume of possession of the belt unit can be reduced.

It is desirable to provide a positioning member being coaxial with the driver roller for positioning of the belt unit relative to the apparatus body. According to the desirable example, since the drive roller has the positioning member, the insertion into the guide member of the apparatus body is facilitated when the belt unit is attached, and the position accuracy of attachment between the drive members of the belt unit and the apparatus body is easy to secure.

A color image forming apparatus according to still another aspect of the present invention is provided with paper feed means situated in a lower part of the apparatus, a plurality of process units each having a developer unit containing toner of a different color and a photoconductor, exposure means for performing scan for exposing the photoconductor, and fusing means for fusing a toner image on recording paper. The process unit can be detached and attached from the upper surface of the apparatus. The exposure means is situated below the belt unit. The fusing means is situated above the belt unit. The secondary transfer position is situated farther forward than the primary transfer position in the apparatus body. Thereby, by opening and closing the front door including the elements disposed at the secondary position situated farther forward than the recording paper conveyance path, the belt unit becomes detachable and attachable.

DETAILED DESCRIPTION OF THE INVENTION

Hereinafter, preferred embodiments of the present invention will be described with reference to FIG. 1 to FIG. 12.

[First Embodiment]

Figures 1A, 1B:
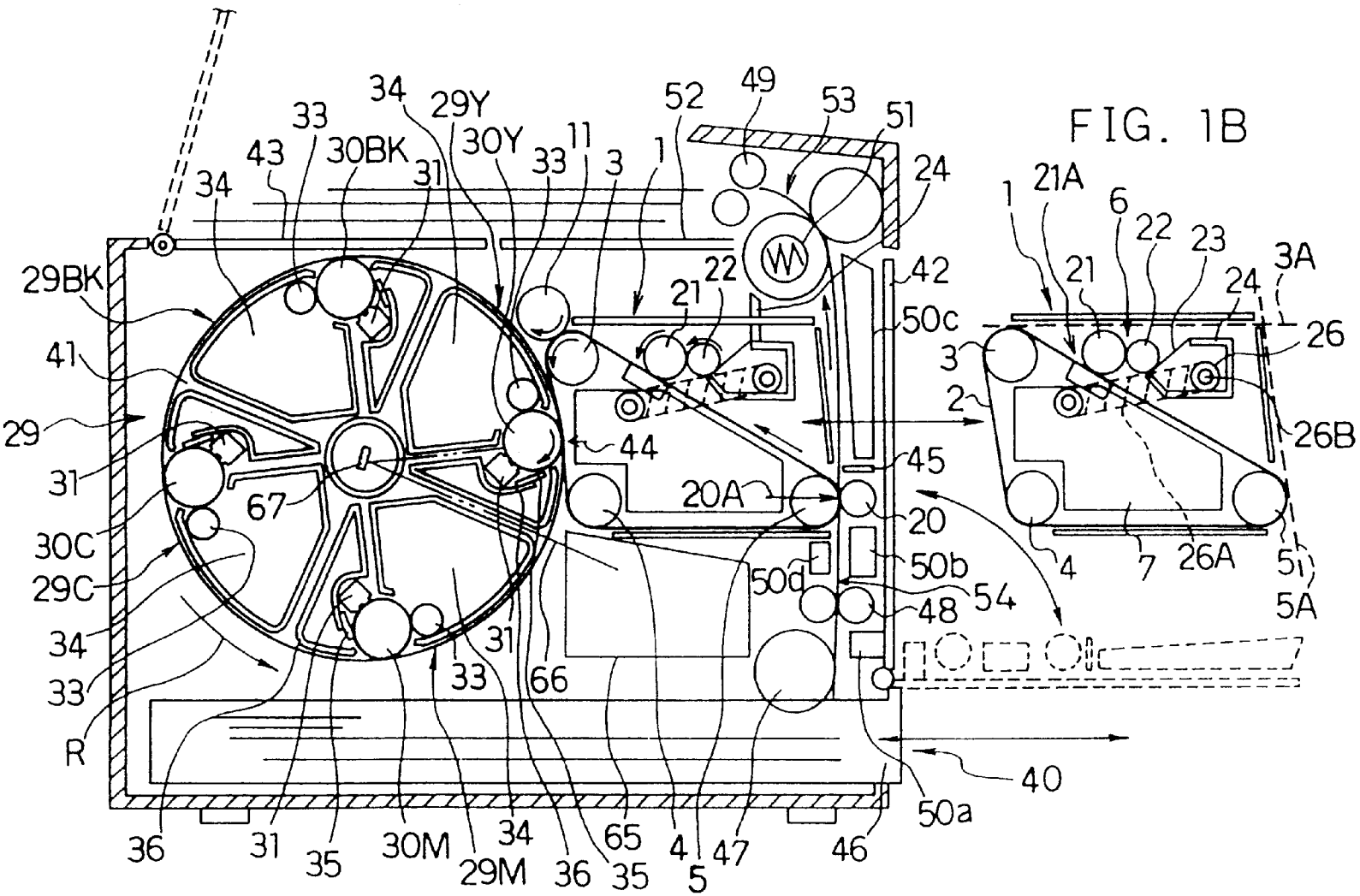
FIG. 1A is a cross-sectional elevation view showing a color image forming apparatus according to a first embodiment of the present invention.
FIG. 1B is a side view showing a cleaner unit.

A color image forming apparatus of a first embodiment shown in FIG. 1A has a belt unit 1 shown in FIG. 1B in detail. The belt unit 1 has the following elements formed in one unit: an intermediate transfer belt 2; a total of three support rollers, namely a drive roller 3, a tension roller 4 and an opposed roller 5 for secondary transfer for holding the intermediate transfer belt 2; a cleaner 6; and a waste toner case 7 for storing waste toner. The belt unit 1 is structured so as to be separable from the body of the apparatus as one unit.

The intermediate transfer belt 2 is an endless belt with a thickness of approximately 150 $\mu$m. The intermediate transfer belt 2 is made of, for example, a film of semi-conductive polycarbonate with a surface electric resistance of $5\times10^{-9}$ Ω.The surface electric resistance can be selected in the range of $5\times10^{-8}$ to $5\times10^{-10}$ Ω. The intermediate transfer belt 2 has thereon a plurality of position detection marks (not shown) for the image formation start positions to coincide on the intermediate transfer belt 2. The circumferential length of the intermediate transfer belt 2 is 377 mm which is the addition of the size along the length of A4-size paper (297 mm) and a length slightly larger than the distance from the exposure position to the primary transfer position (80 mm). The width of the intermediate transfer belt 2 is approximately 250 mm.

Figure 2:
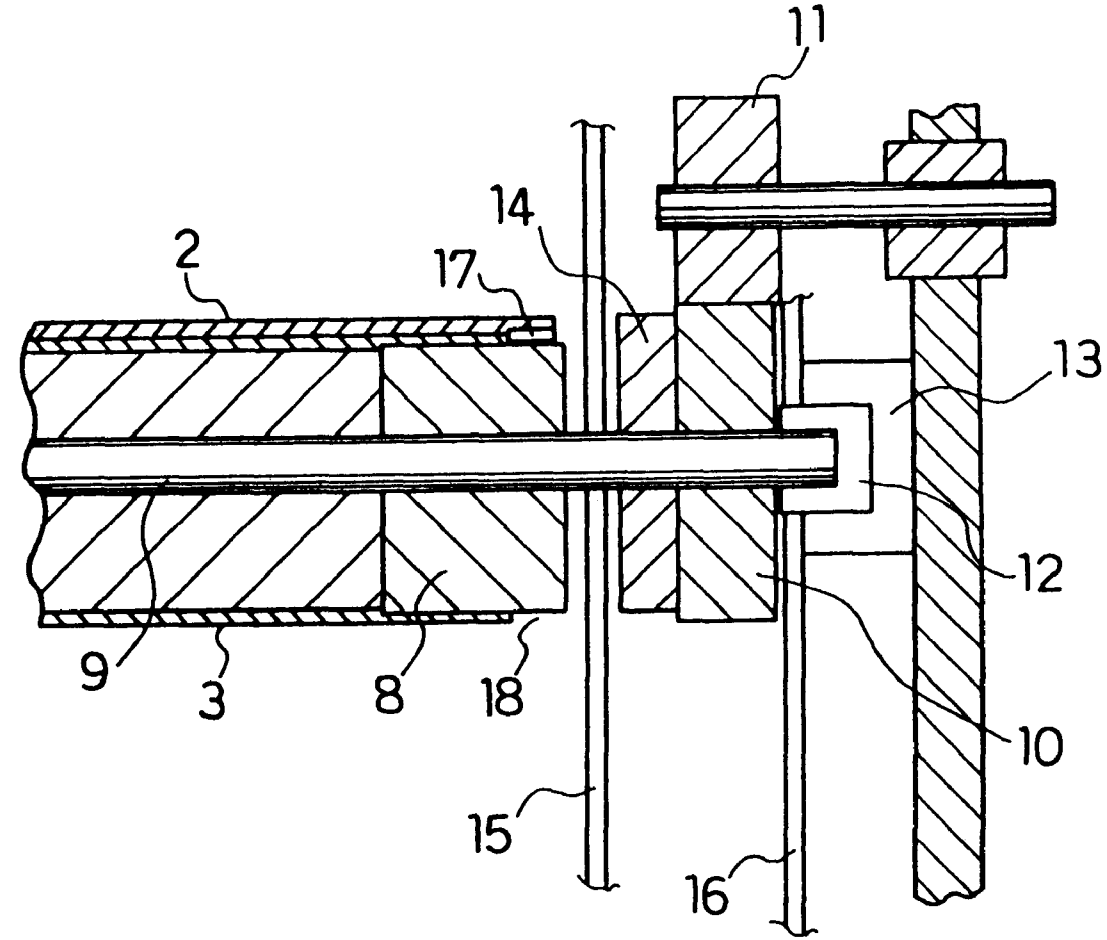
FIG. 2 is a cross-sectional view showing an end portion of a drive roller in the first embodiment of the present invention.

FIG. 2 is a view showing the cross section of an end portion of the drive roller 3 for driving the intermediate transfer belt 2 when the belt unit 1 is attached to the apparatus body. A rotation shaft 9 of the drive roller is disposed through a flange 8 at the end of the drive roller 3. A drive gear 10 is attached to the end of the rotation shaft 9. The drive gear 10 meshes with a gear 11 provided on the body side and transmits a drive force to the drive roller 3. A collar 12 provided at each end of the rotation shaft 9 engages with a guide member 13 provided on the body side and decides the attitude and the position of the belt unit 1. A drive pulley 14 of a timing belt for transmitting a drive force to a cleaner roller 21 shown in FIG. 1 is disposed coaxially with the drive roller 3. A belt unit side plate 15 is provided for holding the rotation shaft 9.

In FIG. 1A, the opposed roller 5 is opposed to the secondary transfer roller 20 for transferring the toner image on the intermediate transfer belt 2 onto the recording paper. The tension roller 4 supplies tension to the intermediate transfer belt 2. By the tension roller 4, the intermediate transfer belt 2 is supplied with a tension of 2 to 3 kgf. The intermediate transfer belt 2 is entrained about the drive roller 3, the tension roller 4 and the opposed roller 5, and rotates in the direction of the arrow of the figure in accordance with the rotation of the drive roller 3. The three support rollers, namely the drive roller 3, the tension roller 4 and the opposed roller 5 are each made of an aluminum pipe with a diameter of 30 mm. The support rollers rotate four times every time the intermediate transfer belt 2 rotates once. The three supports rollers are held by the belt unit side plate 15 shown in FIG. 2. A unit case 16 is the exterior case of the belt unit 1.

Figure 3:
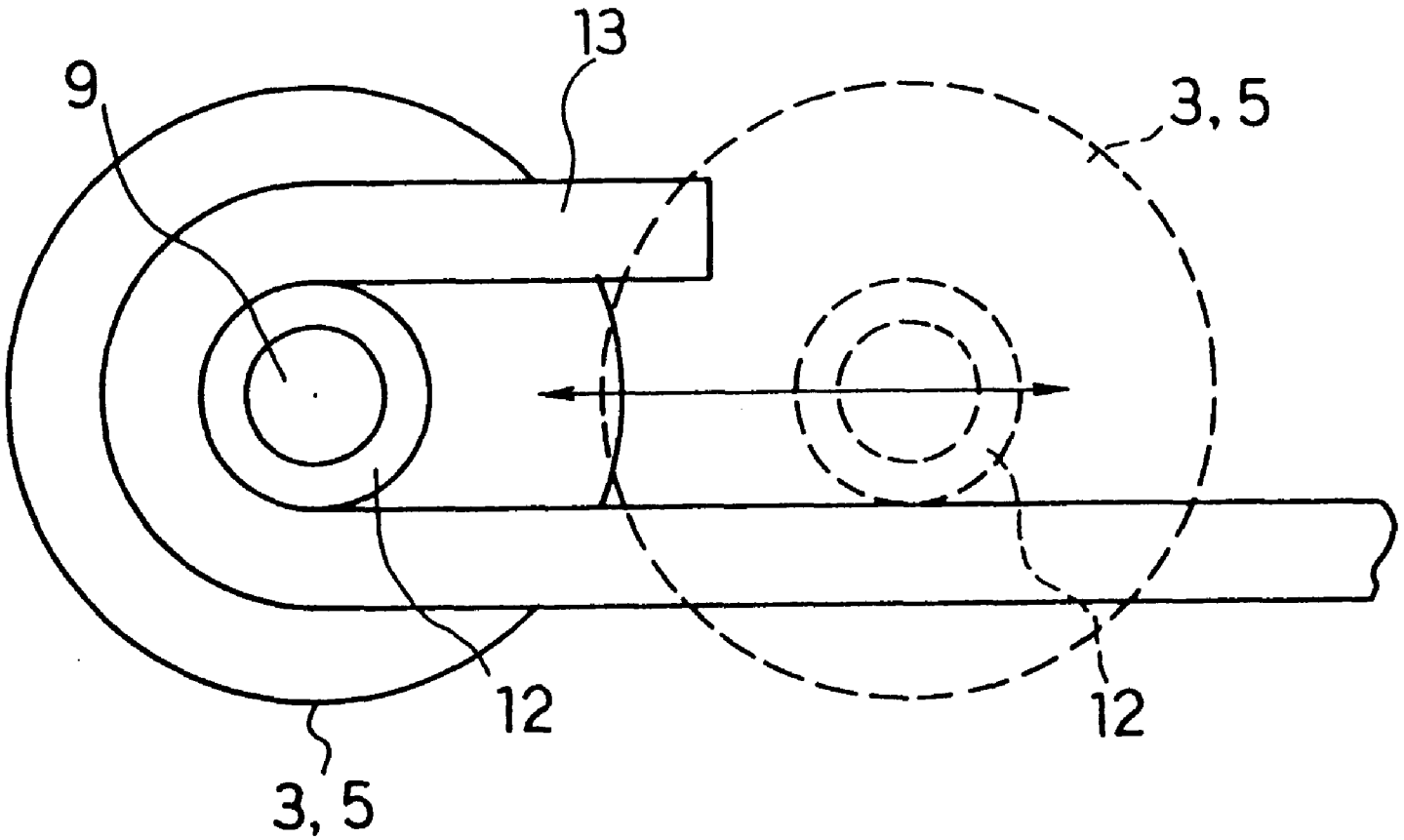
FIG. 3 is a side view showing the structure of a positioning member in the first embodiment of the present invention.

When the belt unit 1 is attached to the apparatus body 40, as shown in FIG. 3, the collar 12 provided at each end of the shafts of the drive roller 3 and the opposed roller 5 engages with the guide member 13 provided on the apparatus body 40, so that the belt unit 1 is surely positioned in a predetermined position. In FIG. 1A, the part of the intermediate transfer belt 2 stretching between the drive roller 3 and the tension roller 4 is in contact with a photoconductor 30Y. The belt unit 1 is electrically coupled to the apparatus body 40 by non-illustrated coupling means. As shown in FIG. 2, the drive gear 10 of the drive roller 3 meshes with the gear 11 provided on the apparatus body 40, so that the intermediate transfer belt 2 is rotatable.

The angle at which the intermediate transfer belt 2 is turned along the drive roller 3 is larger than the angle at which the intermediate transfer belt 2 is turned along the tension roller 4. As shown in FIG. 2, a meander prevention rib 17 is provided on the inner surface at each end of the intermediate transfer belt 2. A meander prevention groove 18 with which the meander prevention rib 17 engages is provided at each end of the drive roller 3, the tension roller 4 and the opposed roller 5.

Figure 4:
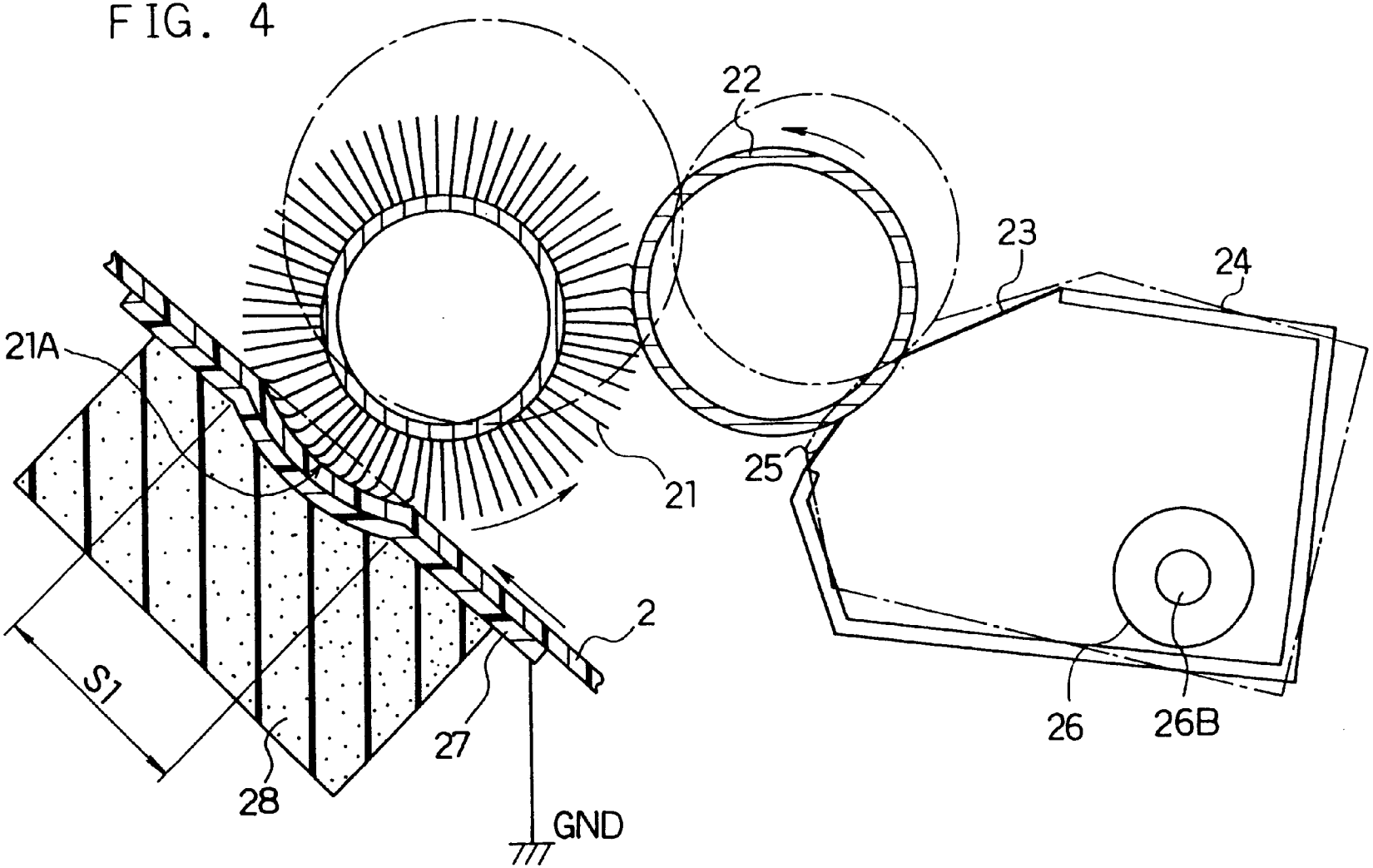
FIG. 4 is an enlarged side view showing a cleaning section in the first embodiment of the present invention.

In FIG. 1A and FIG. 1B, the semi-conductive cleaner roller 21 is provided for removing the residual toner on the intermediate transfer belt 2. To form the cleaner roller 21, a fur brush in which semi-conductive rayon brush fibers with a thickness of 6 deniers are planted at a density of $10^5$ fibers per one square inch is wound around an aluminum core with an outside diameter of 16 mm so as to have an outside diameter of 26 mm (13 mm in radius). For example, the resistance value when the cleaner roller 21 with a length of 250 mm is in contact with a metal plate at a pressure such that the radius decreases from 13 mm to 12 mm is $10^6$ to $10^{10}$ Ω. The cleaner roller 21 is positioned so as to be separated from and brought into contact with the intermediate transfer belt 2 between the drive roller 3 and the opposed roller 5. A collection roller 22 is a stainless steel roller with an outside diameter of 16 mm for collecting toner removed by the cleaner roller 21. A scraper 23 is provided for scraping the toner collected by the collection roller 22, and a stainless steel plate with a thickness of 40 $\mu$m is pressed against the collection roller 22. A toner case 24 is a container for catching the scraped toner. In the partially enlarged view of FIG. 4 showing the cleaning section, a scoop seal 25 prevents the toner collected into the toner case 24 from spilling through the gap between the collection roller 22 and the toner case 24. In the toner case 24, a screw 26 is provided for conveying the collected toner outside the toner case 24. The conveyed toner is further conveyed by another screw 26A shown in FIG. 1B into the waste toner case 7 provided inside a loop of the intermediate transfer belt 2. As shown by a chain line in FIG. 4, the cleaner 6 rotates about a shaft 26B of the screw 26 so that the cleaner roller 21 is separated from the intermediate transfer belt 2. As shown by a solid line in FIG. 4, when the cleaner roller 21 is pressed against the intermediate transfer belt 2, the periphery of the cleaner roller 21 is situated 1 mm inside the common tangential line of the drive roller 3 and the opposed roller 5.

In the enlarged view of FIG. 4 showing the cleaning section including the cleaner roller 21, the cleaner roller 21 is pressed against the surface of the intermediate transfer belt 2. An opposed electrode sheet 27 disposed on the reverse surface of the intermediate transfer belt 2 is made of a conductive resin sheet where carbon is dispersed in resin having a low coefficient of friction of surface such as TEFLON™ (tetrafluoroethylene) with a thickness of approximately 30 $\mu$m and is fixed on a frame (not shown). The opposed electrode sheet 27 is held at the GND potential. The intermediate transfer belt 2 smoothly moves on the surface of the opposed electrode sheet 27. A backup member 28 is a sponge-like resin member having flexibility, and is disposed so as to be in contact with the opposed electrode sheet 27 on the reverse surface of the intermediate transfer belt 2 at a position where the cleaner roller 21 is pressed against the surface of the intermediate transfer belt 2. In cleaning, the opposed electrode sheet 27 is pushed by the backup member 28 and presses the intermediate transfer belt 2 against the cleaner roller 21. At this time, the backup member 28 deforms in accordance with the difference between the encroachment amount of the cleaner roller 21 and the deformation amount of the cleaner roller 21. When the cleaner roller 21 is separated from the intermediate transfer belt 2, as shown by the chain line, the backup member 28 is separated from the intermediate transfer belt 2 and hardly affects the transportation of the intermediate transfer belt 2. In this embodiment, current flows from the collection roller 22 by way of the cleaner roller 21 and the intermediate transfer belt 2 to the opposed electrode sheet 27, and a voltage lower by a degree corresponding to the voltage drop by the collection roller 22 is applied to the cleaner roller 21.

In FIG. 1B, the cleaner 6 is disposed within a region enclosed by the intermediate transfer belt 2, the tangential line 3A of the drive roller 3 parallel to the common tangential line of the peripheries of the tension roller 4 and the opposed roller 5, and the tangential line 5A of the opposed roller 5 parallel to the common tangential line of the peripheries of the drive roller 3 and the tension roller 4.

In FIG. 4, the screw 26 is driven by a timing belt (not shown) entrained about a screw pulley (not shown) fixed coaxially and the drive pulley 14 provided on the drive roller 3. The cleaner roller 21 and the collection roller 22 are driven by the directions of the arrows through a gear (not shown) provided on the shaft of the screw 26.

Figure 13:
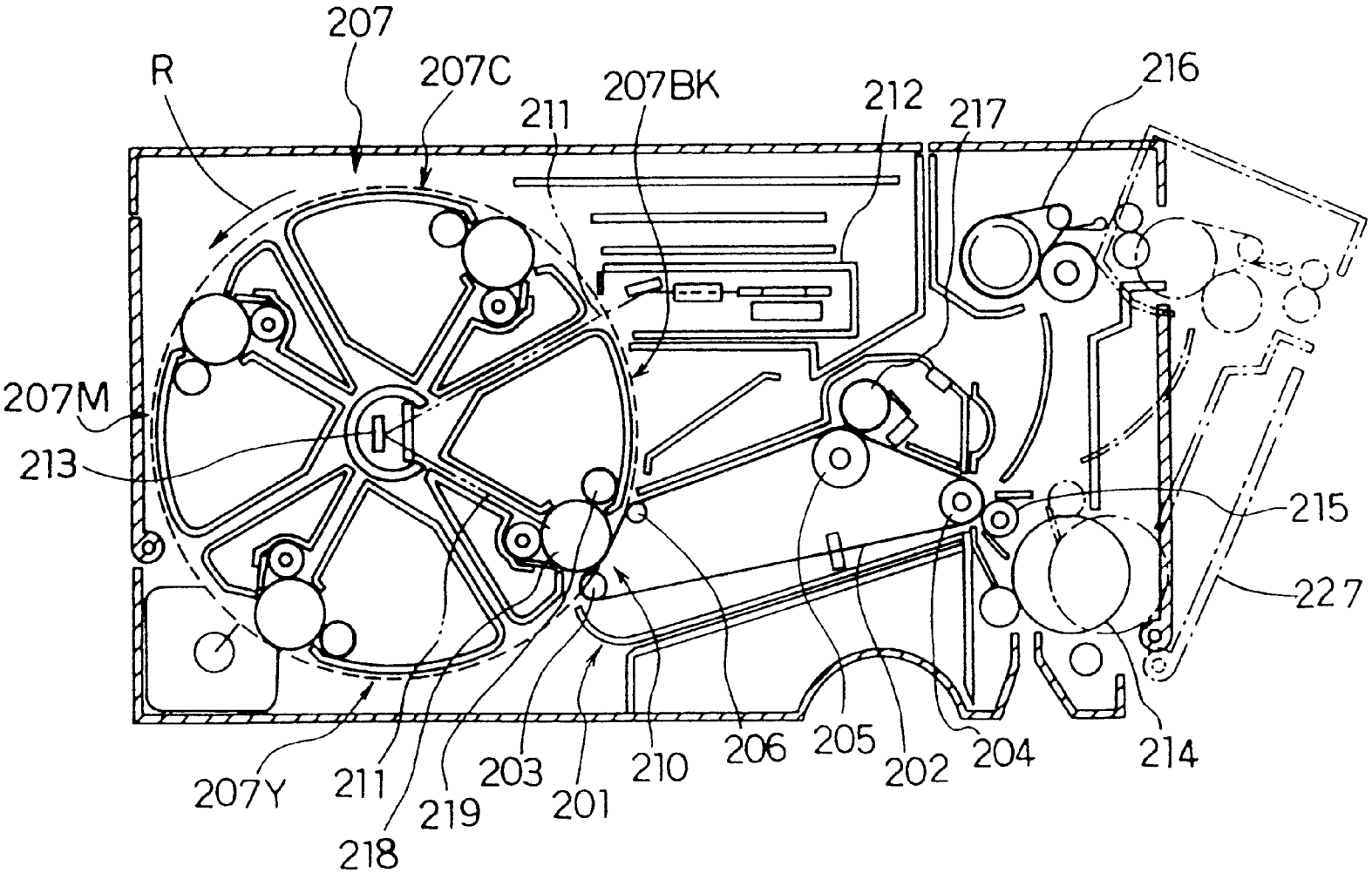
FIG. 13 (PRIOR ART)
FIG. 13 is the cross-sectional elevation view showing the conventional color image forming apparatus.
Figure 14:
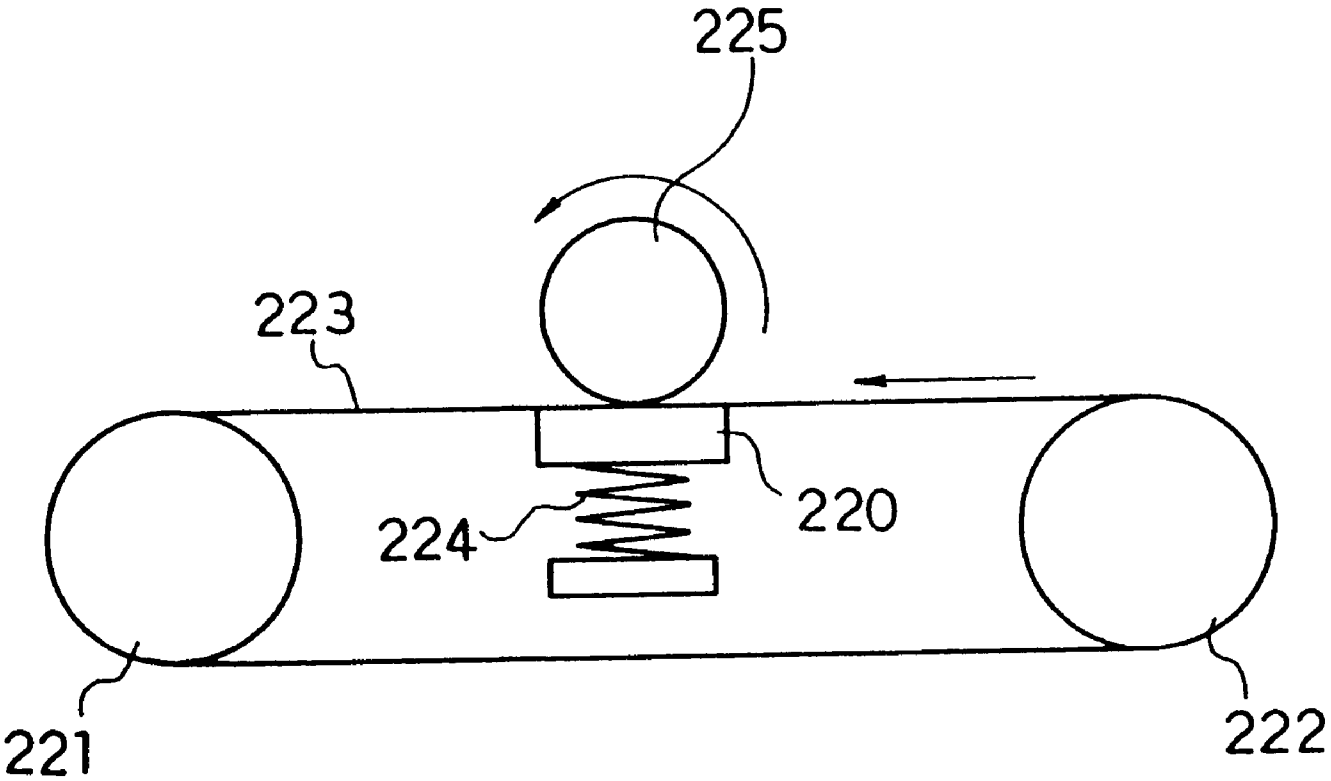
FIG. 14 (PRIOR ART)
FIG. 14 is the cross-sectional elevation view showing the belt cleaner of another conventional example.
Figure 15:
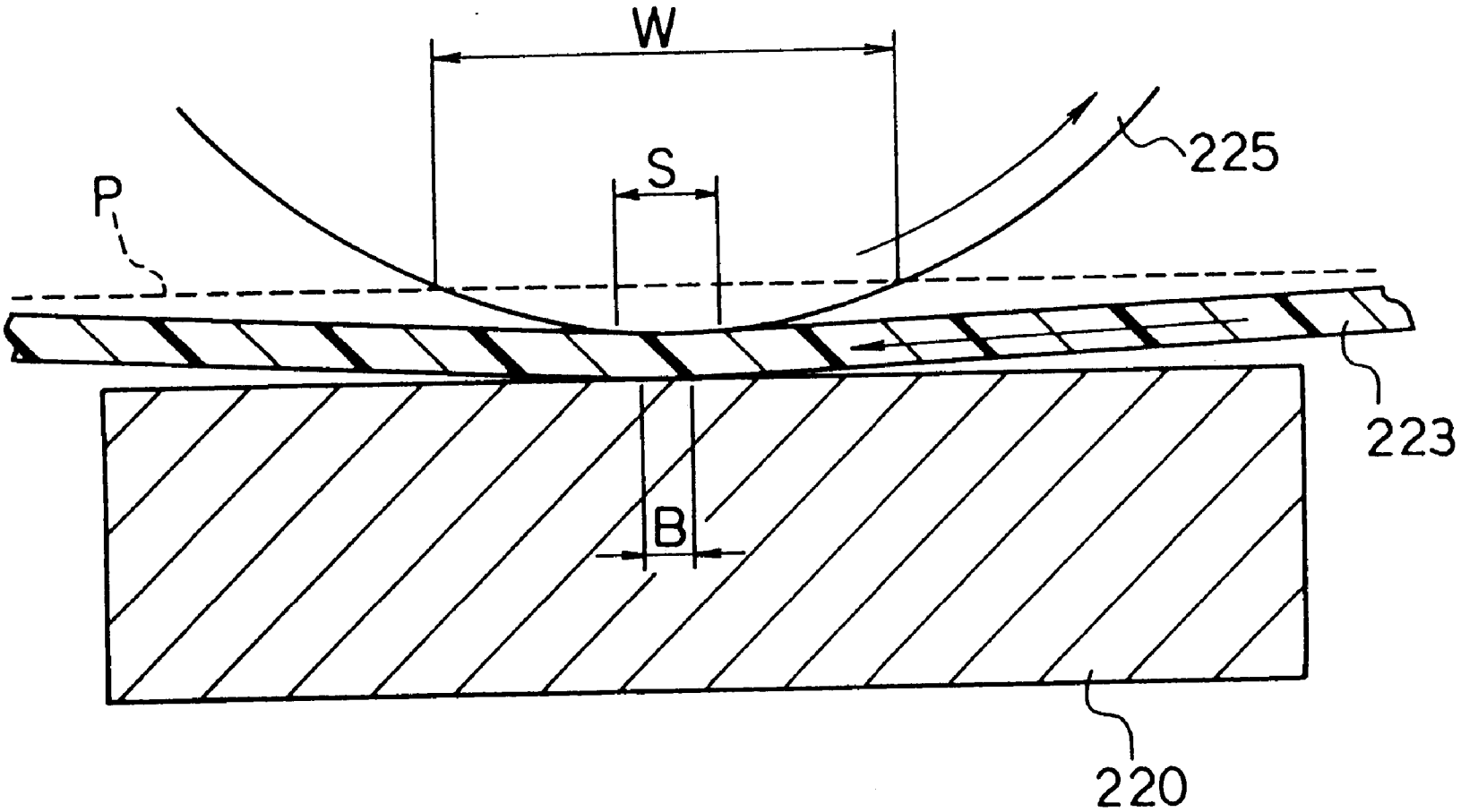
FIG. 15 (PRIOR ART)
FIG. 15 is the enlarged side view showing the cleaning section of the belt cleaner of the conventional example.
Figure 16:
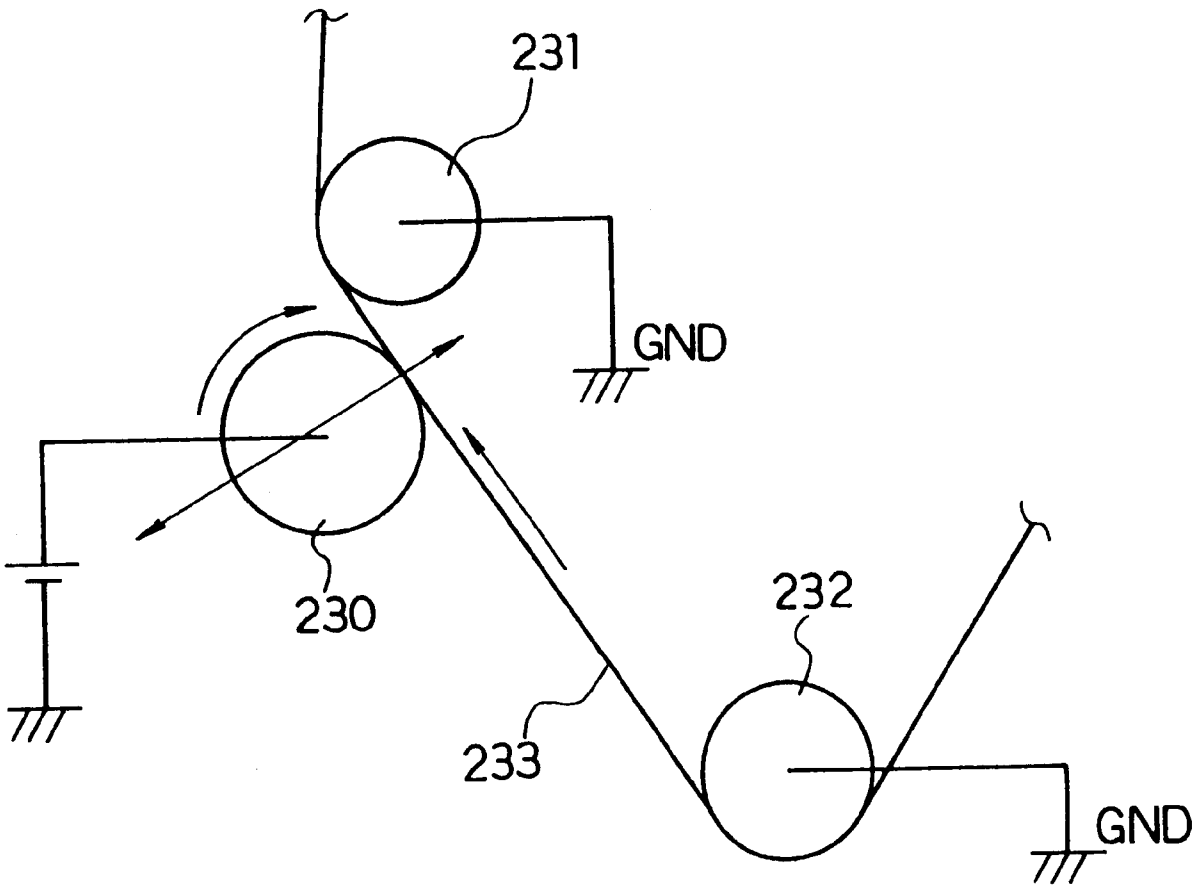
FIG. 16 (PRIOR ART)
FIG. 16 is the cross-sectional elevation view showing the belt cleaner of yet another conventional example.
Figure 17:
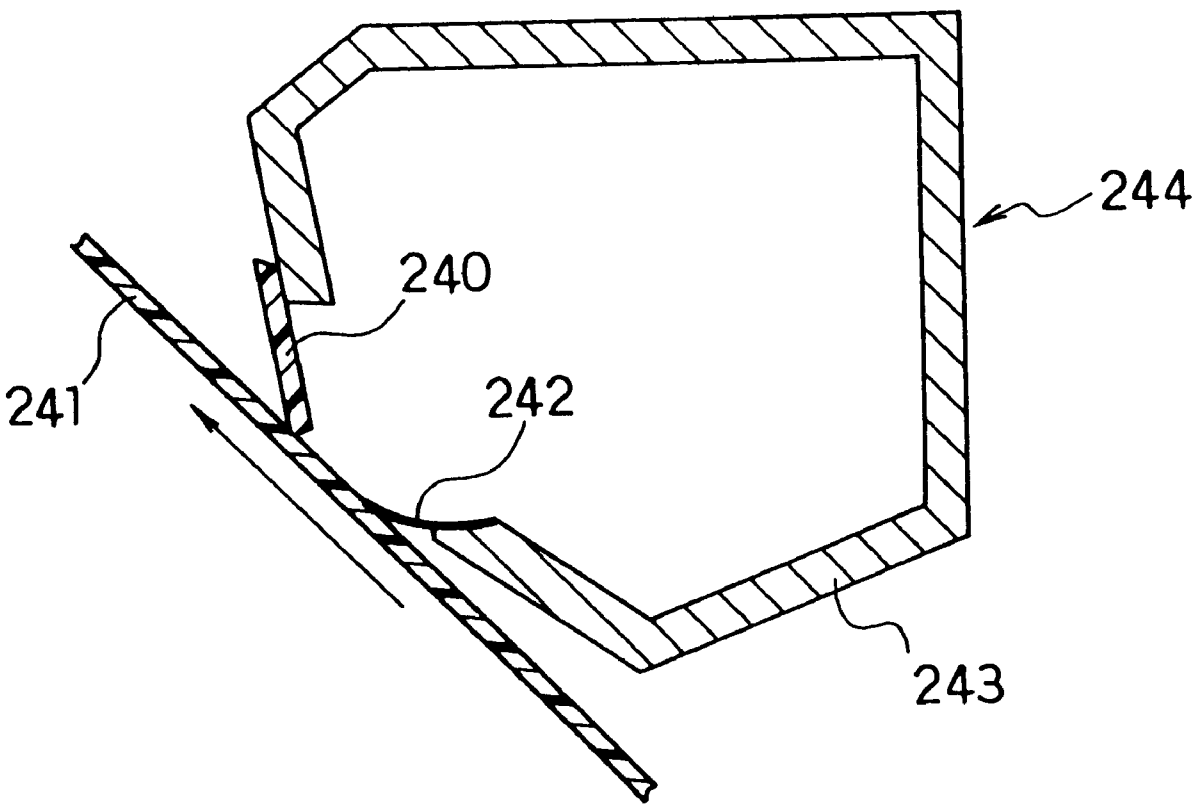
FIG. 17 (PRIOR ART)
FIG. 17 is the cross-sectional elevation view showing the belt cleaner of still another conventional example.

In FIG. 1A, an image forming unit 29 provided for each of yellow, magenta, cyan and black comprises the photoconductor 30Y, 30M, 30C and 30Bk, and other process elements disposed therearound which are formed in one unit. The image forming units 29 each comprise parts having the functions described below. The image forming units 29 have the structure and the function substantially the same as those included in the conventional color image forming apparatus shown in FIG. 13.

A corona charger 31 is disposed close to the surface of each of the photoconductors 30Y, 30M, 30C and 30Bk, and uniformly positively charges the photoconductors 30Y to 30Bk. Developer units 34 each have a development roller, and contain negatively charged toner comprising polyester resin in which pigments are dispersed. The toner is carried on the surface of the developer roller 33 and develops the latent image on the photoconductor 30. The cleaner 36 has a rubber cleaning blade 35 for cleaning the residual toner on the surface of the photoconductor after transfer. The diameter of the photoconductor 30 is 30 mm. The diameter of the development roller 33 is approximately 18 mm. The photoconductor 30Y to 30Bk and the development roller 33 are rotatably supported by the side surfaces of the image forming unit 29.

In FIG. 1A, the right side surface is the front surface of the color image forming apparatus, and a front door 42 is provided at the front surface. On the upper surface of the apparatus, an upper door 43 is provided.

A carriage 41 is provided in the rear part of the apparatus body. The carriage 41 contains the image forming units 29Y, 29M, 29C and 29Bk for forming images of the four colors. The carriage 41 rotates in the direction shown by the arrow R, and successively moves the image forming units 29Y to 29Bk from a retreat position to an image formation position. By opening the upper door 43, the image forming units 29Y to 29Bk can be attached to and detached from the carriage 41 from the upper surface of the apparatus body 40. The image forming units 29Y to 29Bk operate only when they are at the image formation position 44 where they are in contact with the transfer belt unit 1, and do not operate when they are at other positions.

A charge removal needle is a needle-like member for dissipating charges of the recording paper. A paper feed unit 46 can be drawn toward the front of the apparatus (toward the right of the figure) for replenishing recording paper. The recording paper in the paper feed unit 46 is conveyed by well-known paper feed members such as a pickup roller 47, resist rollers 48, paper guides 50*a* to 50*d* and paper discharge rollers 49, and discharged onto a paper discharge tray 52 by way of a fuser unit 51. The recording paper is conveyed along a paper path 53 by these members.

The front door 42 is attached to the apparatus body 40 by a hinge, and can be opened by being tilted forward. The secondary transfer roller 20, the charge removal needle 45 and the paper guides 50*a*, 50*b* and 50*c* are attached to the front door 42. When the front door 42 is tilted forward, these members are also tilted forward. Consequently, the front surface of the apparatus body 40 is opened, and the belt unit 1 can be attached and detached through this part with the opposed roller 5 on the operator's side. The attachment and detachment direction is parallel to the common tangential line of the peripheries of the opposed roller 5 and the tension roller 4. When paper jam occurs, the jammed paper can be easily removed by opening the front door 42.

In the first embodiment, the intermediate transfer belt 2 of the transfer belt unit 1 rotates once every time image formation of one color is performed. The belt length from the primary transfer image formation position 44 where the belt 2 is in contact with the photoconductor 30Y to 30 Bk to the position of the cleaner roller 21 is smaller than the image recording length. The cleaner 6 including the cleaner roller 21 does not hinder the conveyance of the recording paper because it is disposed in the rear of the paper path 53 (in the left of the figure) in the apparatus body. The surface of the intermediate transfer belt 2 where the cleaner 6 is separated or brought into contact is directed to upward, and the normal of the surface is within an angle of 90 degrees from the vertical.

Figure 5:
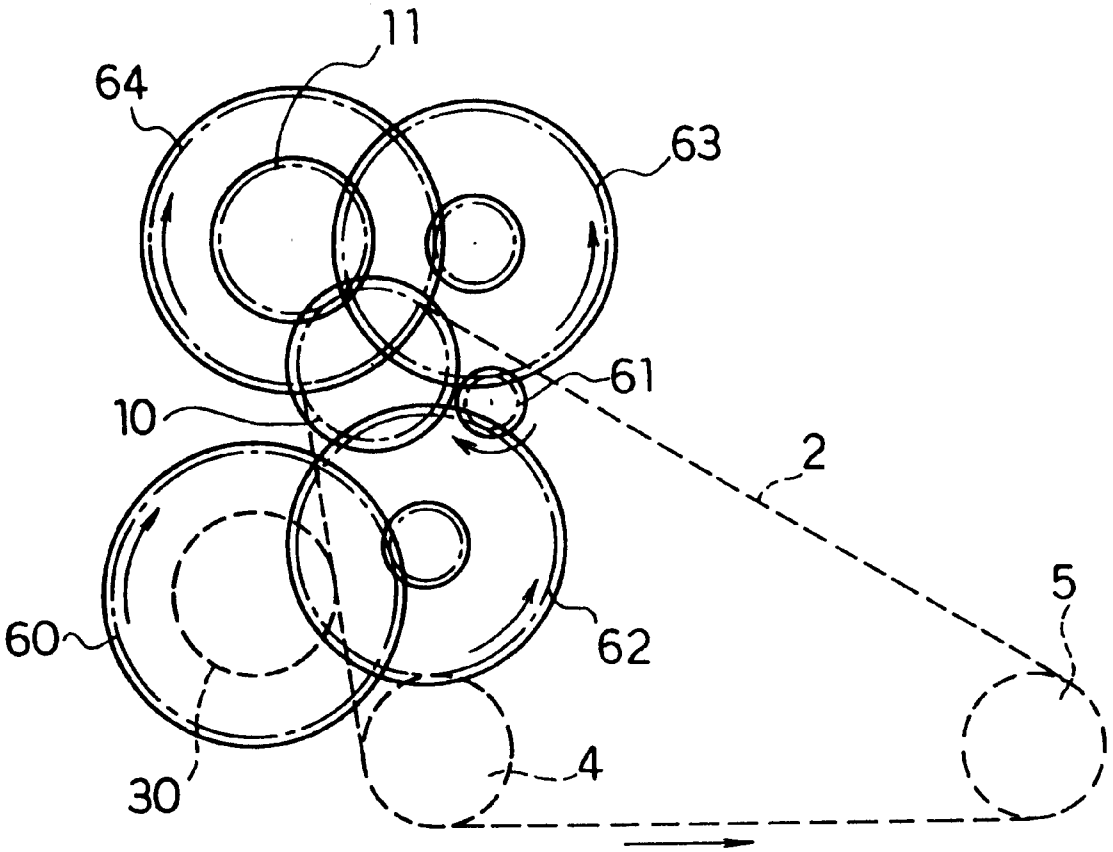
FIG. 5 is a side view showing the structure of a photoconductor and a belt drive system in the first embodiment of the present invention.

FIG. 5 is a view showing the structure of the drive system of the belt unit 1. The drive gear 10 of the belt unit 1 and a photoconductor gear 60 for driving the photoconductors 30Y to 30Bk constitute a series of drive system driven through one motor (not shown) having a motor gear 61, and a plurality of gears. The gears 61, 62, 63 and 64 form the motor gear 61 to the photoconductor drive gear 60 and the belt gear 10 rotate an integral number of times every time the intermediate transfer belt 2 rotates once.

In the belt unit 1 shown in FIG. 1A, the circumferential length of the intermediate transfer belt 2 from the primary transfer position 44 where the belt 2 is in contact with the photoconductor 30Y to a cleaning position 21A is smaller than the image recording length. A secondary transfer position 20A is set at the position of contact between the part of the intermediate transfer belt 2 turning along the opposed roller 5 and the substantially vertical tangential line of the opposed roller 5, and the direction of the paper path 54 along which the recording paper is conveyed is the vertical direction. The cleaner 6 including the cleaner roller 21 does not hinder the conveyance of the recording paper because it is disposed inside the vertical tangential line of the opposed roller 5. At the secondary transfer position, the paper path 54 bends toward the opposed roller 5 at an angle slightly smaller than 180 degrees. The transfer surface of the intermediate transfer belt 2 on which the cleaner 6 is separated or brought into contact faces upward. The screw 26 communicating between the toner case 24 and the waste toner case 7 is substantially horizontal.

An exposure unit 65 is disposed below the belt unit 1. A laser beam 66 from the exposure unit 65 passes through the gap between the image forming unit 29Y and the magenta image forming unit 29M, and is incident on a mirror 67 fixed to the apparatus body 40. The laser beam reflected at the mirror 67 is incident on an exposure section on the left side surface of the photoconductor 30Y of the image forming unit 29Y situated at the image formation position 44, and performs exposure by performing scan in a direction vertical to the plane of the figure. The angle of exit of the laser beam 66 from the exposure unit 65 is approximately 20 degrees upward from the horizontal. The angle of incidence of the laser beam 66 on the photoconductor 30Y is approximately 10 degrees upward from the horizon.

Subsequently, the operation of the color image formation of the above-describe structure will be described.

In FIG. 1A, first, the yellow photoconductor 30Y is positioned at the image formation position 44. Then, a belt drive motor (not shown) of the photoconductor 30Y starts to rotate, and the photoconductor 30Y and the drive roller 3 for rotating the intermediate transfer belt 2 are driven, so that the intermediate transfer belt 2 is rotated in the direction of the arrow. At this time, the circumferential speed of the photoconductor 30Y and the transportation speed of the intermediate transfer belt 2 are substantially the same. At this time, the secondary transfer roller 20 and the cleaner roller 21 are separated from the intermediate transfer belt 2. Another motor which is not shown is activated simultaneously with the activation of the above-mentioned motor and drives the developer roller 33, etc. at the image formation position 44.

After the start of rotation of these motors, when a position detection mark on the intermediate transfer belt 2 is detected, the laser beam 66 in accordance with an image signal is applied from the exposure unit 65 onto the photoconductor 30Y. When the laser beam 66 is applied onto the photoconductor 30Y being uniformly charged, an electrostatic latent image in accordance with the image signal is formed. The electrostatic latent image is converted into a toner image by the developer unit 34. To perform primary transfer, the toner image formed on the photoconductor 30Y is transferred onto the intermediate transfer belt 2 at the image formation position 44 which is the primary transfer section where the photoconductor 30Y is in contact with the intermediate transfer belt 2.

At the time of image formation, the charger 31 charges the photoconductor 30Y to −450 V. The potential of the photoconductor 30Y after exposure is −50 V. When the developer roller 33 faces an uncharged area of the photoconductor 30Y, a DC voltage of +100 V is applied to the developer roller 33. When the developer roller 33 faces the surface of the photoconductor 30Y where an electrostatic latent image is formed, a DC voltage of −200 V is applied to the developer roller 33. To the drive roller 3 for driving the intermediate transfer belt 2 and to the tension roller 4, a DC voltage of +1.0 kV is applied as the primary transfer voltage. The opposed roller 5 is held to the GND potential. To the secondary transfer roller 20, a DC voltage of +1.0 kV is applied as the secondary transfer voltage. Since the electric resistance of the recording paper varies according to the temperature and the humidity, the secondary transfer voltage is varied within a range of ±300 V according to the temperature or the humidity.

Yellow image formation is finished after the rear end of the image is transferred onto the intermediate transfer belt 2, and the photoconductor 30Y and the intermediate transfer belt 2 are returned to the initial positions thereof and stopped. In the above-mentioned process, the intermediate transfer belt 2 rotates once, and the photoconductor 30Y and the three support rollers 3, 4 and 5 rotate four times before they are returned to the initial positions thereof.

After recording of a yellow image is completed, all the operations of the photoconductor 30Y, the intermediate transfer belt 2 and the developer 34, etc. are stopped. Then, to form a magenta toner image, the carriage 41 is rotated 90 degrees in the direction of the arrow R of FIG. 1 so that the magenta image forming unit 29M is moved to the image formation position 44. The process to form a magenta toner image will not be described because it is the same as the above-mentioned process to form a yellow toner image. By this process, yellow and magenta toner images are formed being superimposed on the intermediate transfer belt 2. By repeating the above-mentioned process for cyan and black, toner images of the four colors are formed being superimposed on the intermediate transfer belt 2.

When color change is performed by moving the image forming units 29Y to 29Bk by rotating the carriage 41, the photoconductors 30Y to 30Bk move and rub on the surface of the intermediate transfer belt 2. Since the photoconductors 30Y to 30Bk are opposed to the intermediate transfer belt 2 at a blank part of the intermediate transfer belt 2 between the front and the rear ends of an image where no images are formed, color change operation never disturbs images.

After the start of primary transfer of the toner image of black of the fourth color onto the intermediate transfer belt 2, the secondary transfer roller 20 is brought into contact with the intermediate transfer belt 2 before the front end of the toner image reaches the secondary transfer position 20A. Then, one sheet of recording paper taken out from the paper feed unit 46 is conveyed, being timed by the resist rollers 48, between the secondary transfer roller 20 and the intermediate transfer belt 2, and the toner images of the four colors are transferred onto the recording paper. At this time, a voltage of +1 kV is applied to the secondary transfer roller 20 as the secondary transfer voltage. The recording paper to which toner images have been transferred undergoes fusing as it passes through the fuser unit, and is discharged through the paper discharge rollers 49 onto the paper discharge tray 52.

After the secondary transfer, the cleaner roller 21 comes into contact with the intermediate transfer belt 2 before the front end of the image on the intermediate transfer belt 2 reaches the cleaning position (the position of the cleaner roller 21), and the residual toner is removed. Since the belt circumferential length from the primary transfer position to the cleaning position is shorter than the image recording length, the cleaner roller 21 is pressed against the intermediate transfer belt 2 before the primary transfer of the black image is finished.

The cleaner roller 21 and the collection roller 22 rotate in the directions of the arrows shown in FIG. 1A, and the surfaces thereof move in opposite directions and rub against each other at the position where they are in contact. To the collection roller 22, a voltage of +750 V is applied, so that current flows from the collection roller 22 by way of the cleaner roller 21 and the intermediate transfer belt 2 to the opposed electrode sheet 27 (FIG. 4) of the GND potential. Because of a voltage drop by the collection roller 22, the potential of the cleaner roller 21 is approximately +400 V. Because of the potential difference of 350 V, the negatively charged toner moves from the intermediate transfer belt 2 to the cleaner roller 21 and further to the collection roller 22. Then, the toner is scraped by the scraper 23 and collected into the toner case 24. The collected toner is conveyed to the waste toner case 7 by the screw 26. When the waste toner case 7 is filled with the waste toner because of long-term use, the belt unit 1 including the intermediate transfer belt 2, the drive roller 3, the tension roller 4, the opposed roller 5 and the waste toner case 7 is extracted rightward of FIG. 1A as shown in FIG. 1B, and is replaced with a belt unit 1 including an empty waste toner case 7.

When image formation on one sheet is finished, with the rotation of the intermediate transfer belt 2, etc. being continued, by use of the image forming unit of the last color of the previous image formation, the image of the color of the next image is formed as the toner image of the first color on the intermediate transfer belt 2. At this time, after the rear end of the first image passes the secondary transfer position 20A and the cleaning position where the cleaner roller 21 is situated, the secondary transfer roller 20 and the cleaner roller 21 are separated from the intermediate transfer belt 2 before the front end of the image of the first color of the next image reaches the secondary transfer position 20A and the cleaning position. That is, the cleaner roller 21 is separated from the intermediate transfer belt 2 during the primary transfer of the image of the first color.

When the cleaner roller 21 is separated from the intermediate transfer belt 2, the backup member 28 is hardly in contact with the intermediate transfer belt 2, so that the backup member 28 never hinders the transportation of the intermediate transfer belt 2.

After the image of the first color, black, is transferred onto the intermediate transfer belt 2, the carriage 41 rotates 90 degrees, so that the next yellow image forming unit 29Y is positioned at the image formation position 44 and the toner image of the next color is formed. Then, the process is repeated in a similar manner and a color image is obtained by superimposing the toner images of the four colors. When a color image is continuously formed on a plurality of sheets as described above, the superimposition order of the colors shifts by one color between the previous color image and the next color image.

Effects of the first embodiment are as follows:

By pressing the flexible sheet-form opposed electrode sheet 27 against the intermediate transfer belt 2 by the flexible backup member 28 having elasticity, the intermediate transfer belt 2 hardly deflects with respect to the common tangential line of the drive roller 3 and the opposed roller 5. By the backup member 28, the cleaner roller 21 can be pressed against the intermediate transfer belt 2 in the entire region of encroachment of the cleaner roller 21 on the intermediate transfer belt 2. Even if there are depressions or deformation on the surface of the cleaner roller 21, a stable width S1 of a nip part 21A which is a contact part between the cleaner roller 21 and the intermediate transfer belt 2 can be secured as shown in FIG. 4. Consequently, since sufficiently high values of frictional force and electric field force are secured on the toner on the intermediate transfer belt 2, a sufficiently stable cleaning action works, so that unnecessary toner can be completely removed.

Further, by pressing the flexible sheet-form opposed electrode sheet 27 having elasticity against the intermediate transfer belt 2, the opposed electrode sheet 27 can be brought in contact with the intermediate transfer belt 2 in the entire area of the nip part 21A of the cleaner roller 21 and the intermediate transfer belt 2. Consequently, the electric field for moving toner from the intermediate transfer belt 2 to the cleaner roller 21 can be formed with stability in the entire area of the nip part 21A. This increases the effect of cleaning of toner on the intermediate transfer belt 2, so that unnecessary toner can be completely and stably removed.

Since the backup member 28 does not rotate but is fixed, it is unnecessary for the backup member 28 to be formed to a roller shape, and no bearing is necessary. Consequently, the backup member 28 can be made to a simple and inexpensive structure. Since the backup member 28 is thin, its volume of possession is small, so that the capacity of the waste toner case 7 provided inside the intermediate transfer belt 2 can be increased in accordance with the space saved by the size reduction of the backup member 28.

The secondary transfer roller 20 which is impressed with the secondary transfer voltage varying according to the environment is separated from and brought into contact with the opposed roller 5 adjoining the drive roller 3 which is impressed with the primary transfer voltage. Consequently, the potential of the intermediate transfer belt 2 is apt to be unstable at the cleaning position. However, since the opposed electrode sheet 27 held at the GND potential is pressed against the intermediate transfer belt 2, the potential of the intermediate transfer belt 2 is stabilized, so that stable cleaning performance is always obtained.

The cleaner roller 21 and the intermediate transfer belt 2 are brought into contact by the flexible backup member 28 through the opposed electrode sheet 27 having a low coefficient of friction and flexibility. Thereby, the reaction by pressing the cleaner 21 to the backup member 28 is reduced, so that the frictional force can be reduced. Consequently, the variation in load on the intermediate transfer belt 2 can be restrained, so that slip between the drive roller 3 and the intermediate transfer belt 2 brought about by the load variation and the positional displacement due to warp of the drive system can be prevented. Since the amount of encroachment of the backup member 28 on the intermediate transfer belt 2 is extremely small, the backup member hardly affects the transportation of the intermediate transfer belt 2. Since the encroachment amount is small, the stability of transportation of the intermediate transfer belt is not deteriorated even if the backup member 28 is flexible and apt to deform. Since the cleaner roller 21 is separated from the intermediate transfer belt when the toner image passes the cleaning position 21A, the cleaner roller 21 never disturbs the toner image on the intermediate transfer belt 2.

Since the backup member 28 is rich in flexibility, even if the fur brush on the surface of the cleaner roller 21 is pressed against the intermediate transfer belt 2 for a long time, it never occurs that the fibers of the fur brush deform and the fur lies down. As a result, cleaning can be stably performed over a long period of time.

Since the length from the primary transfer position to the position of the cleaner roller 21 is shorter than the image recording length, the cleaner roller 21 comes into contact with the intermediate transfer belt 2 before the transfer of the toner image onto the intermediate transfer belt 2 is finished, so that the length of the part of the intermediate transfer belt 2 carrying no toner image can be set so as to be shorter than the distance between the cleaner roller 21 and the primary transfer position. Consequently, the circumferential length of the intermediate transfer belt 2 can be reduced, so that the belt unit 1 and the apparatus body can be reduced in size. Since the time necessary for the intermediate transfer belt 2 to rotate once is reduced, the color image formation time requiring four rotations is reduced, so that the color image throughput can be improved.

When images are continuously formed, after the rear end of the toner image of the fourth color of the previous image passes the cleaning position, the cleaner 6 is separated from the intermediate transfer belt 2 before the front end of the toner image of the first color of the next image reaches the cleaning position. Consequently, since the idle rotation time of the intermediate transfer belt 2 and the switching time of the image forming units 29Y to 29M can be reduced, the image throughput can be improved.

The cleaner 6 including the cleaner roller 21 is disposed within a range enclosed by the intermediate transfer belt 2, the tangential line 3A of the drive roller 3 parallel to the common tangential line of the peripheries of the tension roller 4 and the opposed roller 5, and the tangential line 5A of the opposed roller 5 parallel to the common tangential line of the peripheries of the drive roller 3 and the tension roller 4. Consequently, the belt unit 1 has a substantially parallelogrammatic shape without any extreme projections and depressions, so that the volume of possession of the belt unit 1 in the apparatus body is reduced. By attaching and detaching the belt unit 1 by moving it in the direction of the common tangential line of the opposed roller 5 and the tension roller 4, the size of the opening necessary for the attachment and detachment can be minimized, so that the size of the apparatus body 40 can be reduced. Although it is desirable to dispose all the elements of the cleaner 6 within the above-mentioned range, similar effects are obtained by situating at least the central position 21A of the cleaner roller 21 within the range.

Since the common tangential line of the peripheries of the opposed roller 5 and the tension roller 4 is substantially horizontal, the belt unit 1 is attached and detached in the horizontal direction from the front surface of the apparatus body 40. Consequently, the belt unit 1 can be attached and detached even when the position of the fuser unit 51 situated above the belt unit 1 in a slanting direction is lowered and fixed, and the height of the apparatus body 40 can be reduced. The belt unit 1 can be attached and detached only by opening and closing the lightweight front door 42 with the heavy fuser unit 51 being fixed to the apparatus body 40. Since the fuser unit 51 is situated in a front part of the apparatus body 40, the front length of the paper discharge tray 52 that is necessarily as long as the recording sheet is reduced, so that the size of the apparatus body 40 can be reduced in the front-to-rear direction. The cleaner 6 is situated above the waste toner case 7 provided inside the intermediate transfer belt 2. Consequently, even when toner is conveyed from the toner case 24 to the waste toner case 7 substantially in the horizontal direction, the volume of the effective part in the waste toner case 7 where toner is collected can be increased. When toner is conveyed by the screw 26, since it is difficult to convey it in a direction inclining upward from the horizontal, it is desirable to situate the cleaner 6 as high as possible.

When the opposed roller 5 is situated lower than the tension roller 4, the position of the cleaner roller 6 is lowered. When toner is conveyed from the cleaner 6 to the waste toner case 7 within the belt substantially in the horizontal direction under this condition, toner is conveyed to the inside not from the top of the waste toner case 7 but from a middle position. Consequently, the capacity of the effective part in the waste toner case 7 where toner can be collected is reduced. When the opposed roller 5 is situated lower than the tension roller 4, the opening for attaching and detaching the belt unit 1 from the front of the apparatus body 40 is necessarily large, so that the front door 42 and the apparatus body 40 are increased in size.

The drive roller 3, the tension roller 4 and the opposed roller 5 which serve as support rollers of the intermediate transfer belt 2 are expensive because high accuracy is required therefrom. Therefore, the number of support rollers should be minimized. However, if there are only two support rollers, the belt unit 1 is flat and elongated in the front-to-rear direction or in the vertical direction, so that the size of the apparatus body 40 is increased in the front-to-rear direction or in the vertical direction. In the above-mentioned embodiment having three support rollers, the projection area of the belt unit 1 in the front-to-rear direction and in the vertical direction is reduced, so that the apparatus body 40 can be reduced in size. The length-to-height ratio of the belt unit 1 is desirably 3:1 or lower, and more desirably, 2.1 or lower.

In order to convey a postcard-size sheet (148 mm in length), it is necessary that the distance between the secondary transfer roller 20 and the fuser unit 51 be 148 mm or shorter. Therefore, it is desirable that the height of the belt unit 1 be 148 mm or smaller.

In consideration of operability of the belt unit 1, it is desirable for weight reduction that the support rollers be of pipe form. When the diameters of the support rollers are large, by arranging the minimum number, i.e. three support rollers so as to form a triangle, a large space can be secured inside the intermediate transfer belt 2, so that the capacity of the waste toner case 7 provided in the space can be increased.

Since the cleaner roller 21 is included in the belt unit 1, when the belt unit 1 is replaced, waste toner can be discharged outside the apparatus without spilling. When the belt unit 1 is replaced, not only waste toner is discharged outside the apparatus body 40 but also a deteriorated intermediate transfer belt 2 is replaced by a new one. Since these elements are formed in one unit, the position accuracy among the intermediate transfer belt 2, the backup member 28 and the cleaner 6 can be easily maintained at a predetermined value.

By providing the waste toner case 7 inside the intermediate transfer belt 2 and replacing the waste toner case 7 together with the belt unit 1 as one unit, the waste toner can also be taken out of the apparatus body 40 when the intermediate transfer belt 2 is replaced. Consequently, maintenance can be easily performed without the inside of the apparatus body 40 being contaminated by the waste toner. By providing the waste toner case 7 inside the intermediate transfer belt 2, the capacity of the waste toner case 7 can be increased. Consequently, since a large quantity of waste toner can be stored in the belt unit 1 of a comparatively small size, the period of use of the belt unit 1 is extended, so that the copying cost can be reduced. Since the belt unit 1 has no extreme projections and depressions, the size of the opening necessary for attachment and detachment of the belt unit 1 can be minimized, so that the size of the apparatus body can be reduced.

Since the condition of the recording paper is not invariant, paper jam sometimes occurs on the paper path 54 during the recording paper is being conveyed. If the secondary transfer roller 20 is disposed in a rear part of the apparatus (left part of FIG. 1), it is difficult to remove jammed paper when paper jam occurs. In this embodiment, the belt unit 1 is attached and detached with the opposed roller 5 on the operator's side. Since the secondary transfer position 20A is situated at the front surface of the apparatus (right part of the figure) and the paper path 54 is close to the front door 42, jammed paper is easily removed.

In particular, by disposing the cleaner 6 including the cleaner roller 21 inside the vertical tangential line of the opposed roller 5, the paper path 54 is vertical at the secondary transfer position 20A, so that the number of elements disposed farther forward than the paper path 54 (rightward in the figure) is reduced. Consequently, the apparatus body can be reduced in size, and particularly, the front door 42 opened for removing jammed paper can be reduced in size and weight. Although it is desirable to dispose all the elements of the cleaner 6 within the above-mentioned range, similar effects are obtained by situating at least the central position of the cleaner roller 21 within the range.

By disposing the cleaner 6 within the above-mentioned range, the angle of bend of the paper path 54 toward the opposed roller 5 in the front and the rear of the secondary transfer position 20A can be set so as to be slightly smaller than 180 degrees. Consequently, the pressure by the nip part at the secondary transfer position 20A of the secondary transfer roller 20 does not vary even if the tension of the recording paper varies, so that high-quality images without any transfer nonuniformity are obtained.

Since jammed paper can be removed and the belt unit 1 can be attached and detached by opening the front door 42, the body can be simplified in structure and reduced in size.

In this embodiment, since toner is attracted by an electric force by use of the cleaner roller 21, no toner drops onto the intermediate transfer belt 2 when the cleaner roller 21 is separated from the intermediate transfer belt 2, so that the cleaning surface can be set to face upward. Consequently, since the recording paper is conveyed substantially in the vertical direction at the secondary transfer position 20A, the paper path 54 from the paper feed unit 46 in a lower part of the apparatus to the fuser unit 51 in an upper part takes the shortest route close to a straight line, so that the probability of paper jam can be reduced. Since the cleaner 6 is disposed in the downstream side of the secondary transfer position 20A and in the upstream side of the image formation position 44 for primary transfer, the direction of rotation of the intermediate transfer belt 2 coincides with the order of arrangement of the elements. Consequently, there is no waste in the rotation of the intermediate transfer belt 2 and the deterioration of the throughput can be prevented. Since the recording paper feed unit 46 is disposed at the bottom of the apparatus body 40, the paper feed tray does not protrude, so that the apparatus body 40 can be reduced in size. Since the sheets of recording paper on which images have been recorded are stored face down in an upper part of the apparatus, they are piled in the order of pages. Since the paper discharge tray does not protrude, the apparatus body 40 can be reduced in size.

If the cleaner 6 is disposed in a position where the transfer surface of the intermediate transfer belt 2 faces downward, the transfer surface of the intermediate transfer belt 2 after secondary transfer is cleaned after passing the image formation position 44 (primary transfer position) where primary transfer is performed, and the transfer surface again comes to the image formation position 44 after passing the secondary transfer position 20A. That is, the intermediate transfer belt 2 makes one extra rotation, so that the image throughput decreases. In this case, if the rotation direction of the intermediate transfer belt 2 is reversed so that the recording paper is conveyed downward at the secondary transfer position 20A, it is necessary to dispose a paper discharge cassette in a lower part of the apparatus body 40, so that it is difficult to confirm the paper discharge condition. Consequently, it is necessary for the paper discharge tray to protrude from the apparatus, so that the area of installation increases.

By separating the cleaner roller 21 from the intermediate transfer belt 2 at the part of the belt 2 stretching between the support rollers, the frictional force can be reduced by reducing the reaction caused when the cleaner roller 21 is pressed, so that variation in load imposed on the intermediate transfer belt 2 can be restrained. Consequently, slip between the drive roller 3 and the intermediate transfer belt 2 brought about by the load variation and the positional displacement due to warp of the drive system can be prevented. By separating the cleaner 6 when the toner image passes the cleaning position, the toner image on the intermediate transfer belt 2 can be prevented from being disturbed by the cleaner 6.

By performing primary transfer at the part of the intermediate transfer belt 2 stretching between the drive roller 3 and the tension roller 4, the drive roller 3 and the photoconductor 30Y can be disposed close to each other, so that the photoconductor 30Y and the drive unit of the drive roller 3 coupled by the belt is easily formed as a drive system of one unit.

When the support rollers about which the intermediate transfer belt 2 is entrained is warped by the tension of the intermediate transfer belt 2, the tension of the central part in the direction of the width of the intermediate transfer belt 2 decreases, so that the intermediate belt 2 loosens. This loosening creates a gap between the photoconductor 30Y and the intermediate transfer belt 2 at the primary transfer position. At the cleaning position, a gap is created between the cleaner roller 1 and the intermediate transfer belt 2. Consequently, primary transfer and cleaning become faulty. In order to prevent the loosening, it is necessary that the support rollers of the intermediate transfer belt 2 have considerable rigidity. In the above-mentioned embodiment, since aluminum rollers with a diameter of 30 mm having sufficient rigidity are used, the intermediate transfer belt 2 never loosens, so that primary transfer and cleaning never become faulty. Since the transportation path of the intermediate transfer belt 2 is stabilized, the positional displacement can be prevented.

Since the drive roller 3 is situated between the image formation position 44 and the part where the cleaner roller 6 is separated and brought into contact, the transportation condition of the intermediate transfer belt 2 at the nip part of the image formation position 44 does not vary even when the cleaner 6 is separated and brought into contact. Consequently, excellent primary transfer condition is maintained, so that transfer at the central part is prevented from becoming faulty. The surface of the intermediate transfer belt 2 on which the photoconductors 30Y to 30Bk slide when switching among the image forming units 29Y to 29M is performed is the part stretching between the support rollers. Since the intermediate transfer belt 2 has elasticity at the part stretching between the support rollers, the photoconductors 30Y to 30Bk and the intermediate transfer belt 2 are never scratched even if the photoconductors 30Y to 30Bk move and slide on the surface of the intermediate transfer belt 2 at the time of switching.

If the image formation position 44 and the cleaner separation and contact part of the intermediate transfer belt 2 are the same part of the intermediate transfer belt 2, the pressure of the primary transfer nip part varies due to the separation and contact of the cleaner 6, so that primary transfer becomes faulty. If the primary transfer position is set at a part of the intermediate transfer belt 2 turning along a support roller and the photoconductor 30Y to 30Bk being rigid are pressed against this part, an excessive force acts on the primary transfer section 44. This causes scratches on the photoconductors 30Y to 30Bk when they are attached and detached. Since the pressure at the nip part of the primary transfer section increases, transfer becomes faulty at the central part of the intermediate transfer belt 2.

The drive gear 10 and the body-side gear 11 meshing in the circumferential direction are used as members for transmitting the drive force between the belt unit 1 and the apparatus body 40. Consequently, only by attaching the belt unit 1 to the apparatus body 40, the apparatus body 40 and the drive system of the belt unit 1 can be coupled. The drive force of the cleaner 6 is supplied from the drive roller 3. To couple the drive force between the belt unit 1 and the apparatus body 40, it is only necessary to mesh the drive gear 10 of the drive roller 3. Thus, the belt unit 1 can be easily attached and detached.

Since the drive roller 3 is situated closer to the body-side gear 11 than to the cleaner 6, it is unnecessary to provide in the belt unit 1 a relief for avoiding interference with the body-side gear 11 when the belt unit 1 is attached. Consequently, no projections and depressions are caused on the belt unit 1, so that the volume of possession of the belt unit 1 is reduced and the space in the apparatus can be effectively used.

Since the drive roller 3 disposed at the front end of the belt unit 1 has the collar 12, the insertion into the guide member 13 is facilitated when the belt unit 1 is attached and detached. The position accuracy of the body-side gear 11 and the drive gear 10 is easily secured.

In this embodiment, by disposing the exposure means 65 below the belt unit 1, the recording paper pickup roller 47, the resist rollers 48 and the exposure means 65 can be aligned one behind another. Consequently, the members can be disposed at a high density in the apparatus, so that the height of the apparatus body 40 can be restrained for size reduction. Likewise, by disposing the fuser unit 51 above the belt unit 1, the paper discharge tray 52 and the fuser unit 51 can be aligned one behind another. Consequently, the height of the apparatus can be restrained.

As described above, according to the structure of this embodiment, replacement of the process unit 29, removal of jammed paper, replenishment of recording paper and replacement of the intermediate transfer belt 2 can all be performed from the front surface of the apparatus (ride side surface of FIG. 1). Consequently, maintenance is easy. As a result, a color image forming apparatus can be structured that is small in size and has high positioning accuracy, high image quality and high throughput.

The hardness of the sponge member of the backup member 28 is not less than 1 Kgf and not more than 20 Kgf, preferably, not more than 10 Kgf at JIS K 6401.

The backup member 28 is disposed in a position just in contact with the transportation path of the intermediate transfer belt 2. However, the backup member 28 may be away from the intermediate transfer belt at a distance smaller than the amount of encroachment of the cleaner roller 21 on the intermediate transfer belt 2. Conversely, there are occasions when the backup member 28 slightly protrudes inside the transportation path of the intermediate transfer belt 2. In this case, when variation in transportation direction of the intermediate transfer belt 2 in the front and the rear of the backup member 28 is 5 degrees or smaller, the transportation of the intermediate transfer belt 2 is hardly affected, so that the present invention can be similarly embodied.

After secondary transfer and cleaning for the image of the fourth color, black, formed on one sheet is finished, all the operations of the intermediate transfer belt 2 and the image forming unit 29 are stopped. Then, a structure can be realized in which the next color image forming operation is performed by situating the yellow image forming unit 29Y at the image formation position 44 by rotating the carriage 41 90 degrees.

Although a semi-conductive fur brush is used as the cleaner roller 21, the cleaner roller 21 can be similarly formed of a semi-conductive sponge roller or a metal roller having a high-resistance layer such as an alumite layer on the surface.

Similarly, a structure can be realized in which only one photoconductor, one charger and one photoconductor cleaner are used and a color image is formed by successively transferring the toner images formed on the photoconductor onto the intermediate transfer belt 2 by switching only among developer units of the four colors.

The potential difference at the cleaning position depends on a voltage drop caused when current flows by way of the cleaner roller 21 and the intermediate transfer belt 2 to GND because of a voltage applied to the collection roller 22. As another method of providing a potential difference, a structure can be realized in which the cleaner roller 21 is provided with an electrode and the voltage is directly applied to the electrode.

Further, the shaft of the roller may be directly positioned with respect to the apparatus body without the use of the collar 12.

[Second Embodiment]

Figure 6B:
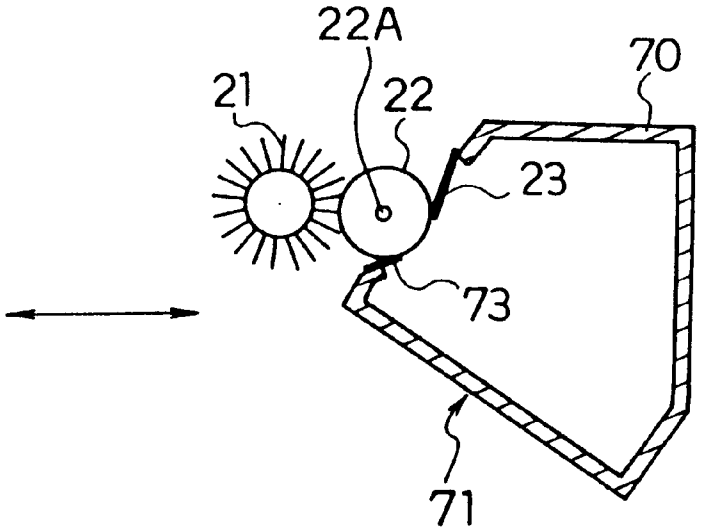
FIG. 6B is a side view showing a cleaner unit.
Figure 6A:
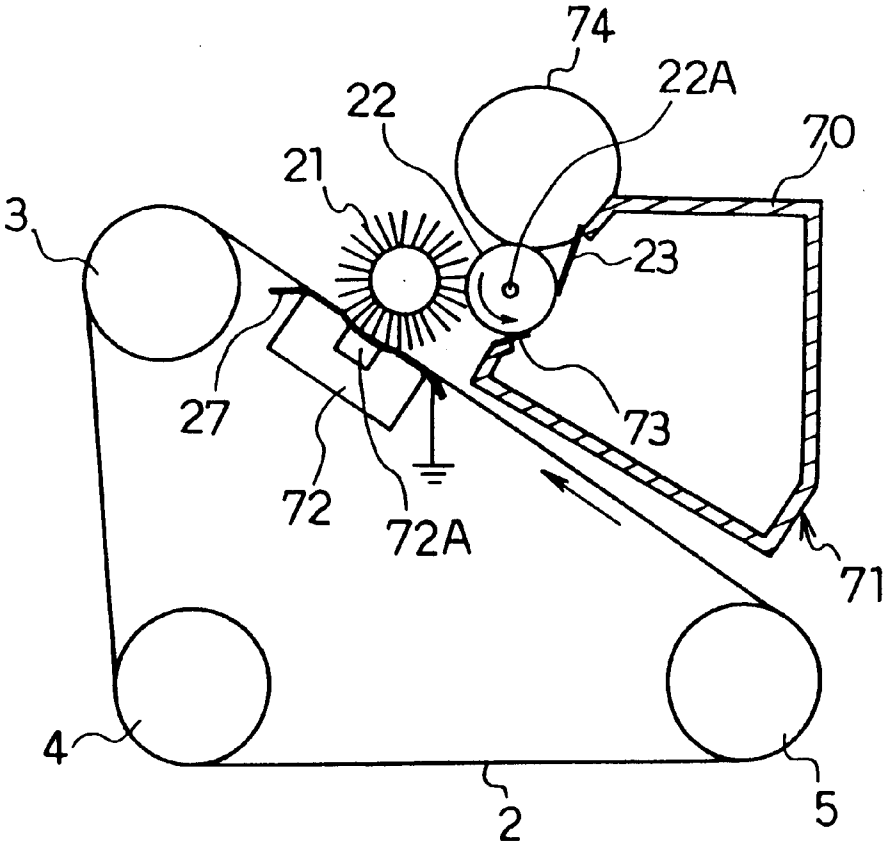
FIG. 6A is a cross-sectional elevation view showing the structure of a cleaner according to a second embodiment of the present invention.
Figure 7:
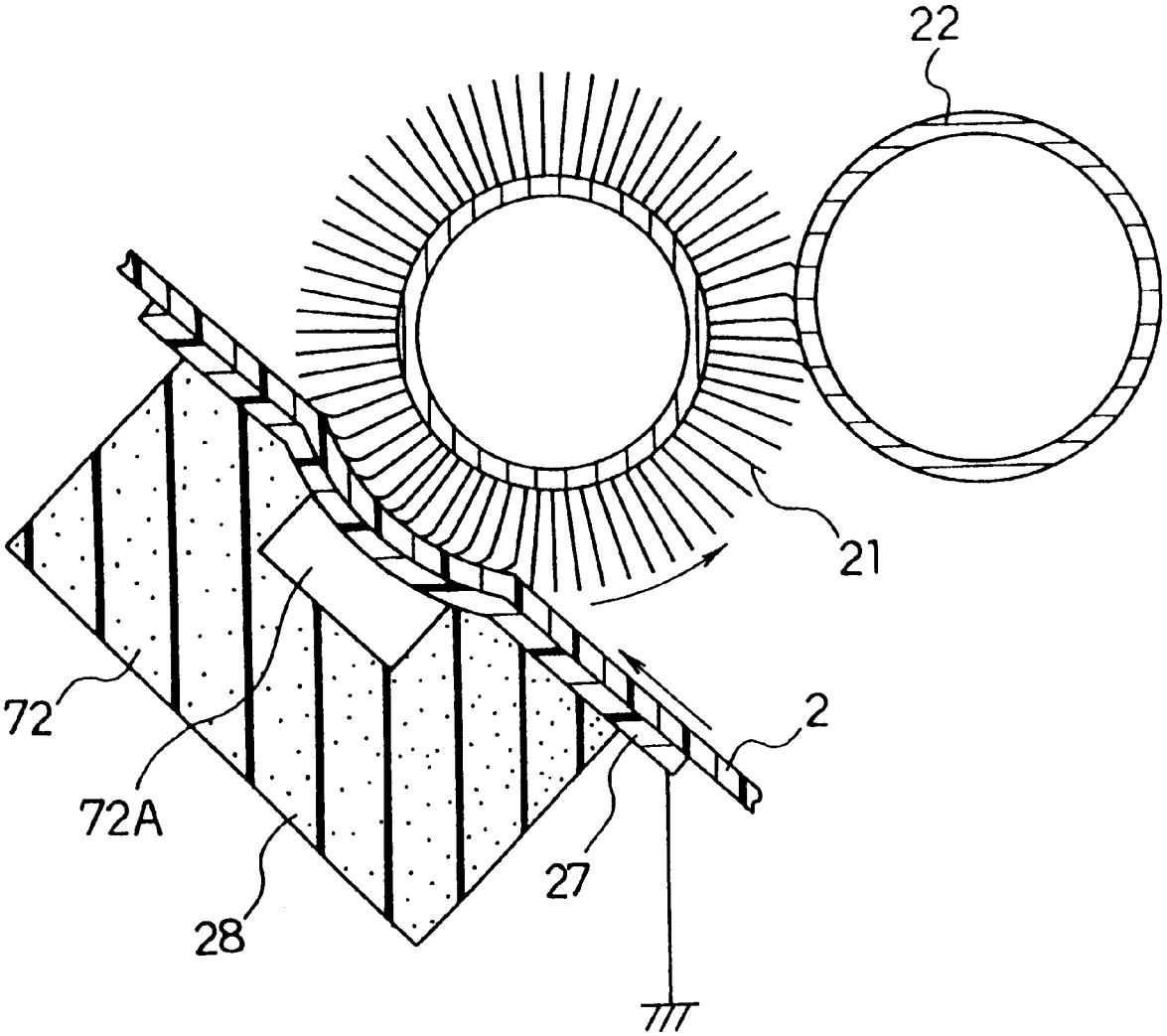
FIG. 7 is an enlarged side view showing a cleaning section according to the second embodiment of the present invention.

FIG. 6A and FIG. 6B are cross-sectional elevation views showing the structure in the vicinity of the intermediate transfer belt of a color image forming apparatus according to a second embodiment. FIG. 7 is an enlarged cross-sectional elevation view showing the part where the cleaner roller 21 is pressed against the intermediate transfer belt 2.

In FIG. 6A, the waste toner case 7 provided in the belt unit 1 of the first embodiment is not situated inside the intermediate transfer belt 2. The intermediate transfer belt 2 and its associated members are fixed to the apparatus body. That is, the cleaner roller 21, the collection roller 22, the scraper 23 and a waste toner case 70 shown in FIG. 6B are formed to be detachably attachable so that they can be taken out from the front of the apparatus body as a cleaner unit 71. In order to prevent toner from spilling through the gap between the waste toner case 70 and the circumferential surface at each end of the collection roller 22, the cleaner unit 71 has a side seal (not shown) made of felt and a scoop seal 73 of PET sheet with a thickness of approximately 50 $\mu$m that is in contact with the entire width of the collection roller 22 with a light load. To drive the cleaner unit 7, a non-illustrated gear provided at the collection roller 22 meshes with a body-side gear 74. By the whole of the cleaner unit 71 rotating about the rotation shaft 22A of the collection roller 22, the cleaner roller 21 is separated from and brought into contact with a surface of the intermediate transfer belt 2 inclining toward the lower right of the apparatus in the figure.

A backup member 72 is provided on the reverse surface of a part of the intermediate transfer belt 2 where the cleaner roller 21 is in contact. The backup member 72 has a concave 72A at a part opposed to the central part of the nip part.

Other structures and operations are similar to those of the first embodiment.

Effects of the second embodiment are as follows: In the second embodiment, the intermediate transfer belt 2 and its associated elements are fixed to the apparatus body. Only the cleaner unit 71 having the cleaner roller 21, the collection roller 22, the scraper 23, the waste toner case 70, the side seal and the scoop seal 73 is formed to be detachably attachable. By replacing the cleaner unit 71, the waste toner can be discharged without spilling. Since the intermediate transfer belt 2 and its associated elements are not replaced, the running cost can be reduced. Since the collection roller 22 and the cleaner roller 21 are formed in one unit, the position accuracy therebetween is easy to maintain.

The intermediate transfer belt 2 is inclined toward the front of the apparatus, and the cleaning unit is disposed at the inclining surface. Since the cleaner unit 71 is attached and detached from the front of the apparatus, convenience of use that all the maintenance works can be performed from the front of the apparatus is not deteriorated.

By providing the concave 72A as a gap at a part of the backup member 72 that abuts the central part of the pressure nip part of the cleaner roller 21, the pressure and the frictional force at the part where the cleaner roller 21 and the intermediate transfer belt 2 are in contact can be further reduced.

Consequently, variation in load of the cleaner 6 imposed on the intermediate transfer belt 2 is further reduced, so that slip between the drive roller 3 and the intermediate transfer belt 2 brought about by the load variation and the positional displacement due to warp of the drive system can be prevented.

[Third Embodiment]

Figure 8B:
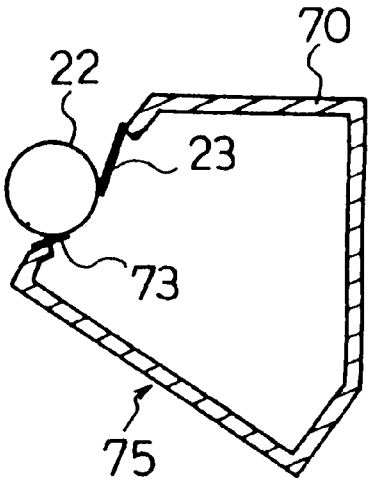
FIG. 8B is a side view showing a cleaner unit.
Figure 8A:
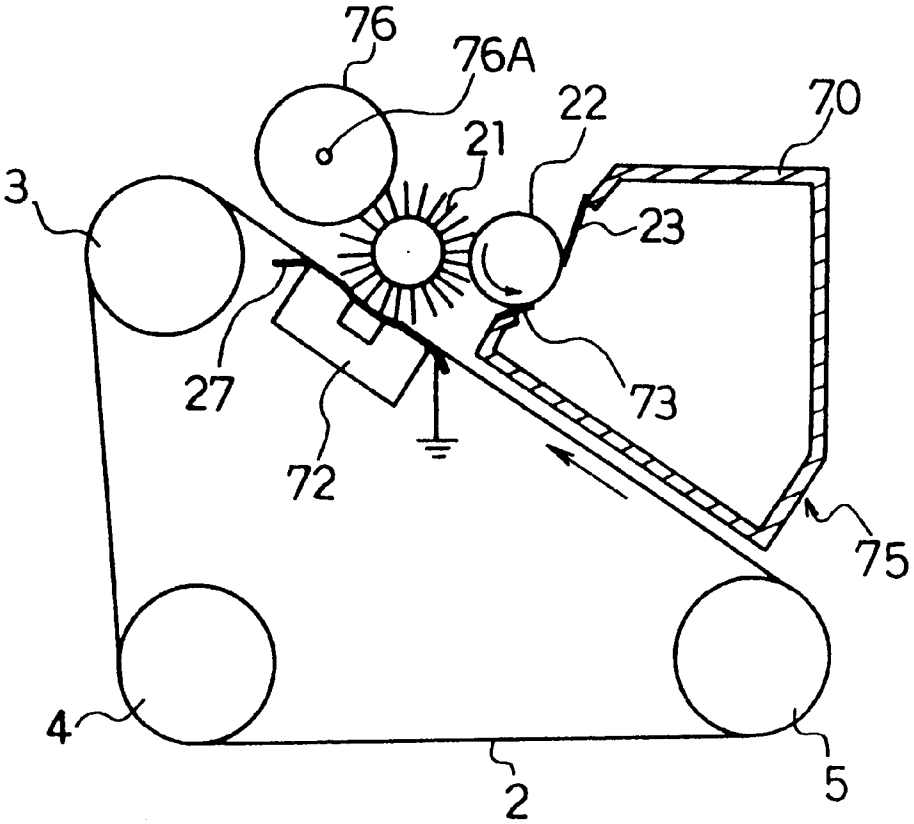
FIG. 8A is a cross-sectional elevation view showing a cleaner according to a third embodiment of the present invention.

FIG. 8A and FIG. 8B are cross-sectional elevation views showing a structure associated with the intermediate transfer belt 2 of a color image forming apparatus according to a third embodiment. In FIG. 8A, the third embodiment is different from the second embodiment in that the cleaner roller 21 is fixed to the apparatus body. The collection roller 22, the scraper 23, the waste toner case 70 and the scoop seal 73 shown in FIG. 8B are formed to be detachably attachable from the front of the apparatus body as a cleaner unit 75. To separate the cleaner roller 21 from the intermediate transfer belt 2, the cleaner roller 21 is rotated about a rotation shaft 76A of a body-side gear 76.

By the above-mentioned structure, the cleaner unit 75 is reduced in size, and the separation and contact mechanism for the cleaner roller 21 is simplified in structure. Since it is unnecessary to replace the cleaner roller 21, the running cost can be further reduced. Since the cleaner unit 75 is attached and detached from the front of the apparatus, convenience of use that all the maintenance works can be performed from the front of the apparatus is not deteriorated.

Although a semi-conductive fur brush is used as the cleaner roller 21 in the above description, a semi-conductor sponge roller may be used, and the cleaner roller 21 can be similarly structured as long as the contact electric resistance caused when it is in contact with the collection roller is 0.1 MΩ to 10 GΩ, preferably, 1.0 MΩ to 1 GΩ.

[Fourth Embodiment]

Figure 9B:
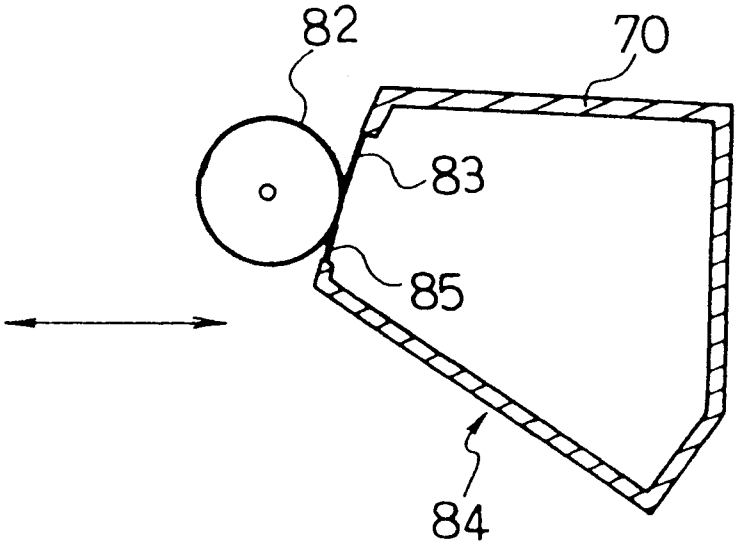
FIG. 9B is a side view showing a cleaner unit.
Figure 9A:
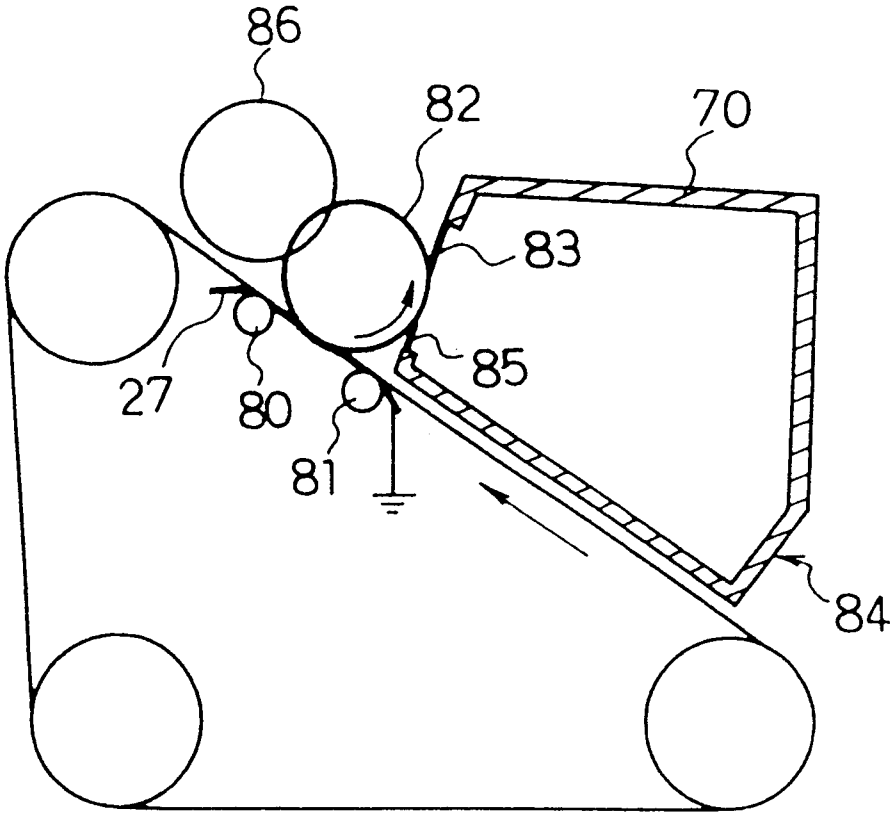
FIG. 9A is a cross-sectional elevation view showing a cleaner according to a fourth embodiment of the present invention.
Figure 10:
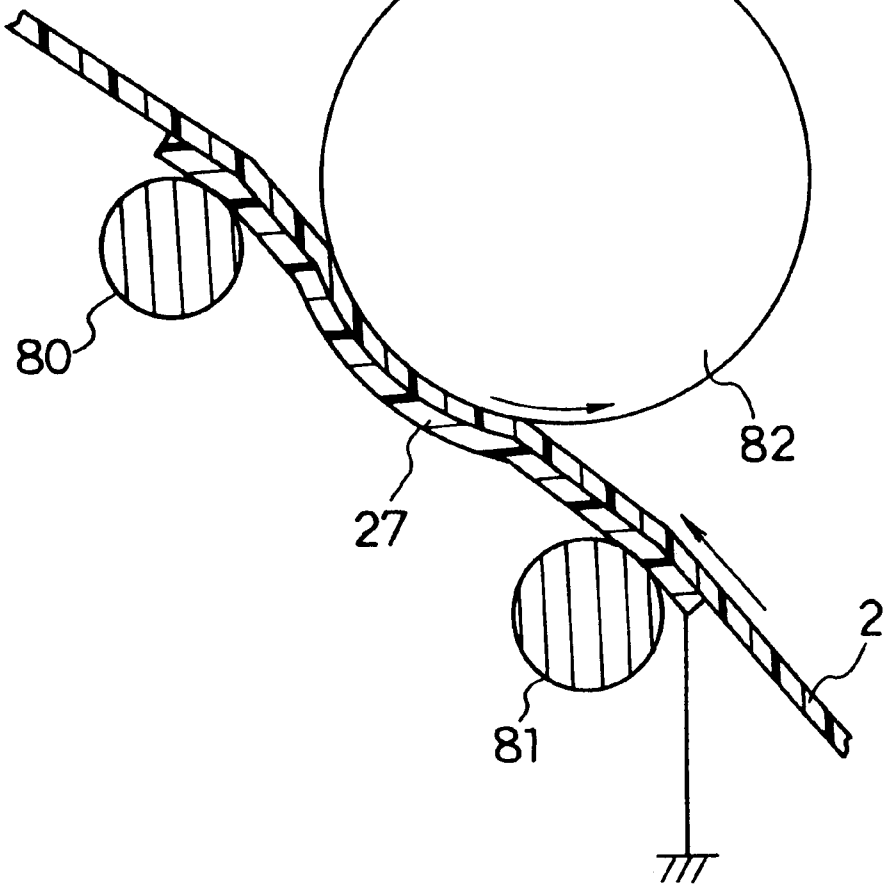
FIG. 10 is an enlarged side view showing a cleaning section according to the fourth embodiment of the present invention.

FIG. 9A and FIG. 9B are views showing a structure associated with the intermediate transfer belt 2 of a color image forming apparatus according to a fourth embodiment. FIG. 10 is an enlarged view showing a part where a cleaner roller 82 is pressed against the intermediate transfer belt 2 in the fourth embodiment. In FIG. 9A, backup members 80 and 81 made of metal abut the opposed electrode sheet 27. The cleaner roller 82 is made of aluminum of which surface is alumite-treated. A scraper 83 is pressed against the cleaner roller 82. At the time of cleaning, a voltage of +500 V is directly applied to the cleaner roller 82. As shown in FIG. 9B, a cleaner unit 84 including the cleaner roller 82, the scraper 83 and the waste toner case 70 is formed to be detachable and attachable from the front of the apparatus body. In order to prevent toner from spilling through the gap between the waste toner case 70 and the circumferential surface at each end of the cleaner roller 82, the cleaner unit 84 has a side seal (not shown) made of felt and a scoop seal 85 of PET sheet with a thickness of 50 $\mu$m that is in contact with the entire width of the cleaner roller 82 with a light load. To drive the cleaner unit 84, a gear provided at the cleaner roller 82 meshes with a body-side gear 86. By the whole of the cleaner unit 84 moving toward the left of the figure, the cleaner roller 82 is separated from a surface of the intermediate transfer belt 2 inclining toward the left of the figure.

In this embodiment, as shown in FIG. 10, the cylindrical metal backup member 81 is disposed in the upstream side of the pressure nip part of the cleaner roller 82, and the cylindrical metal backup member 80 is disposed in the downstream side. For the backup members 80 and 81, cylinders or square pillars that do not rotate are used. The opposed electrode sheet 27 is stretched under the nip part between the backup members 80 and 81 and fixed to the backup member 81.

The opposed electrode sheet 27 is stretched between the backup member 81 in the upstream side and the backup member 80 in the downstream side due to the frictional force between the backup member 80 in the downstream side and the intermediate transfer belt 2, and is in contact with the intermediate transfer belt 2 that deforms by being pressed by the cleaner 82. Other structures and operations are similar to those of the second embodiment.

Effects of the fourth embodiment are as follows:

By disposing the backup members 80 and 81 in the upstream side and in the downstream side of the pressure nip part of the cleaner roller 82 and disposing only the opposed electrode sheet 27 under the nip part, the pressure and the frictional force at the nip part between the cleaner roller 82 and the intermediate transfer belt 2 can be further reduced. Consequently, variation in load of the cleaner roller 6 imposed on the intermediate transfer belt 2 is reduced, so that slip between the drive roller 3 and the intermediate transfer belt 2 brought about by the load variation and the positional displacement due to warp of the drive system can be prevented.

By using the metal cleaner roller 82, the collection means can be formed of only the scraper 83. Compared to the fur brush and the sponge roller, the metal-made cleaner roller is inexpensive and simple in structure.

In the metal cleaner roller 82, if the electric resistance on the surface is low, charge is supplied from the cleaner roller to the toner in the nip part, so that the toner is charged to a polarity opposite to the polarity to which the toner is normally charged. Since the oppositely charged toner is the same in polarity as the voltage applied to the cleaner roller, cleaning cannot be performed by the cleaner roller. As a result, toner sometimes remains on the intermediate transfer belt 2.

In this embodiment, the electric resistance on the surface is increased by alumite-treating the surface of the metal cleaner roller 82. Consequently, the supply of charge to the toner in the nip part is restrained, so that the above-mentioned generation of the oppositely charged toner can be prevented. As a result, the toner on the intermediate transfer belt 2 can be completely removed.

Although the metal cleaner roller 82 is a metal roller having its surface alumite-treated, it can be similarly realized by covering the surface of a metal roller with a semi-conductive resin tube or by coating the surface with semi-conductive resin. By setting the contact resistance between the cleaner roller 82 and the intermediate transfer belt to 0.1 MΩ to 10 GΩ, preferably, to 1.0 MΩ to 1 GΩ, excellent cleaning performance is obtained. If the resistance value is too high, charge is held on the surface of the cleaner roller 82, so that the potential on the surface takes a value different from that of the applied voltage, and thereby the cleaning performance deteriorates.

When the cleaner roller 82 is high in hardness like metals, the reaction caused by pressing the cleaner roller 82 to the hard backup member increases. Consequently, the frictional force increases between the intermediate transfer belt 2 and the cleaner roller 82, and between the intermediate transfer belt 2 and the backup member, so that the load variation is apt to be excessive. Therefore, when the cleaner roller 82 is a metal roller, particularly great effects are produced by the structure of this embodiment using the flexible electrode sheet 27 as the opposed electrode member.

Although a conductive resin sheet is used for the opposed electrode sheet 27, the opposed electrode sheet 27 can be similarly realized by applying a conductive material onto a thin metal sheet or an elastic sheet. The material of the opposed electrode sheet 27 is not limited. The material of the opposed electrode sheet 27 having an electric resistance of 1 MΩ or lower and flexibility is usable. It is preferable that the opposed electrode sheet 27 deforms along the inner surface of the intermediate transfer belt 2 by the elastic pressure of the backup members 80 and 81 when the cleaner roller 82 is pressed against the intermediate transfer belt. It is desirable that the opposed electrode 27 be made of a material having lubricity and abrasion resistance because it slides on the inner surface of the intermediate transfer belt 2.

[Fifth Embodiment]

Figure 11:
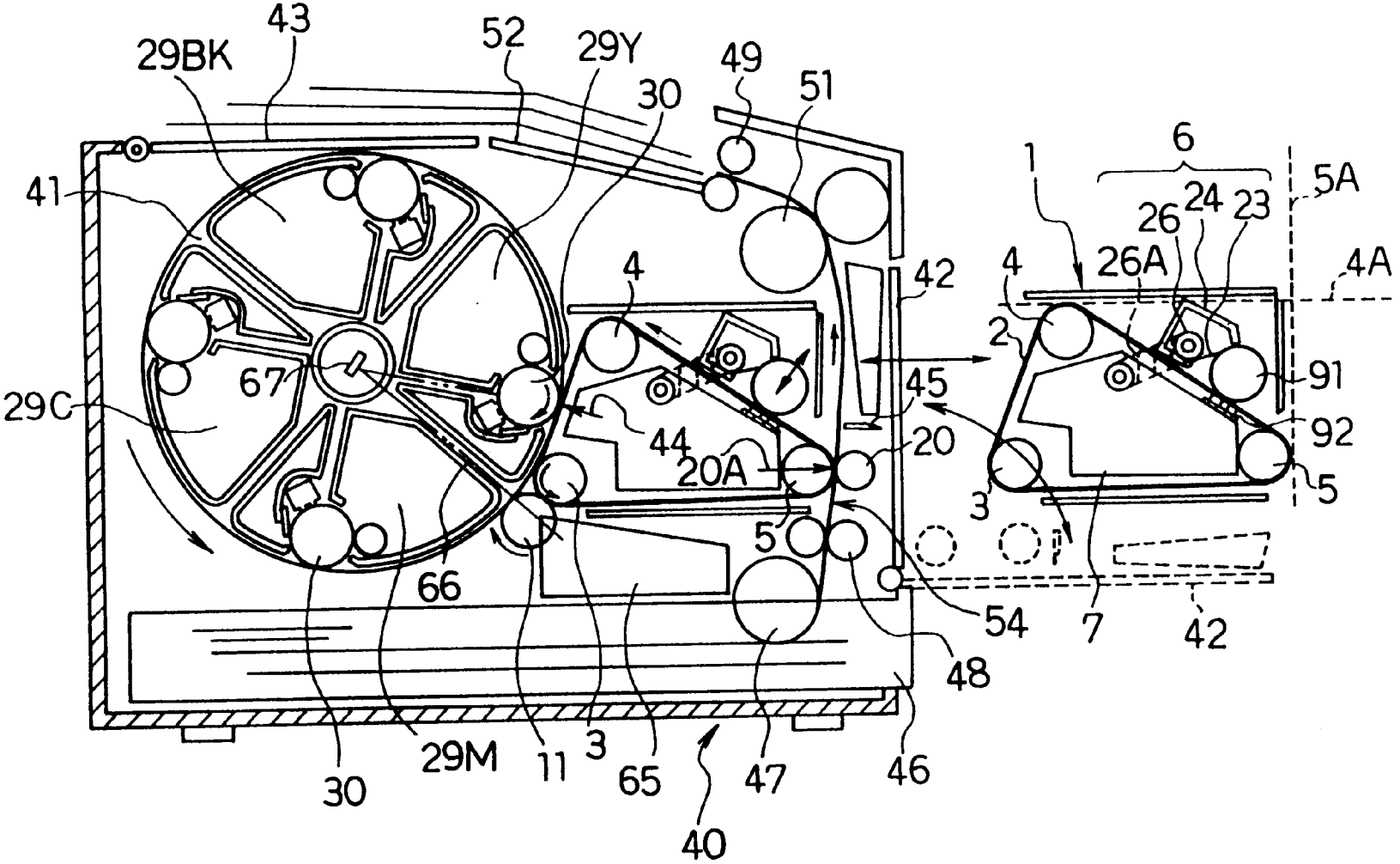
FIG. 11 is a cross-sectional elevation view showing a color image forming apparatus according to a fifth embodiment of the present invention.
Figure 12:
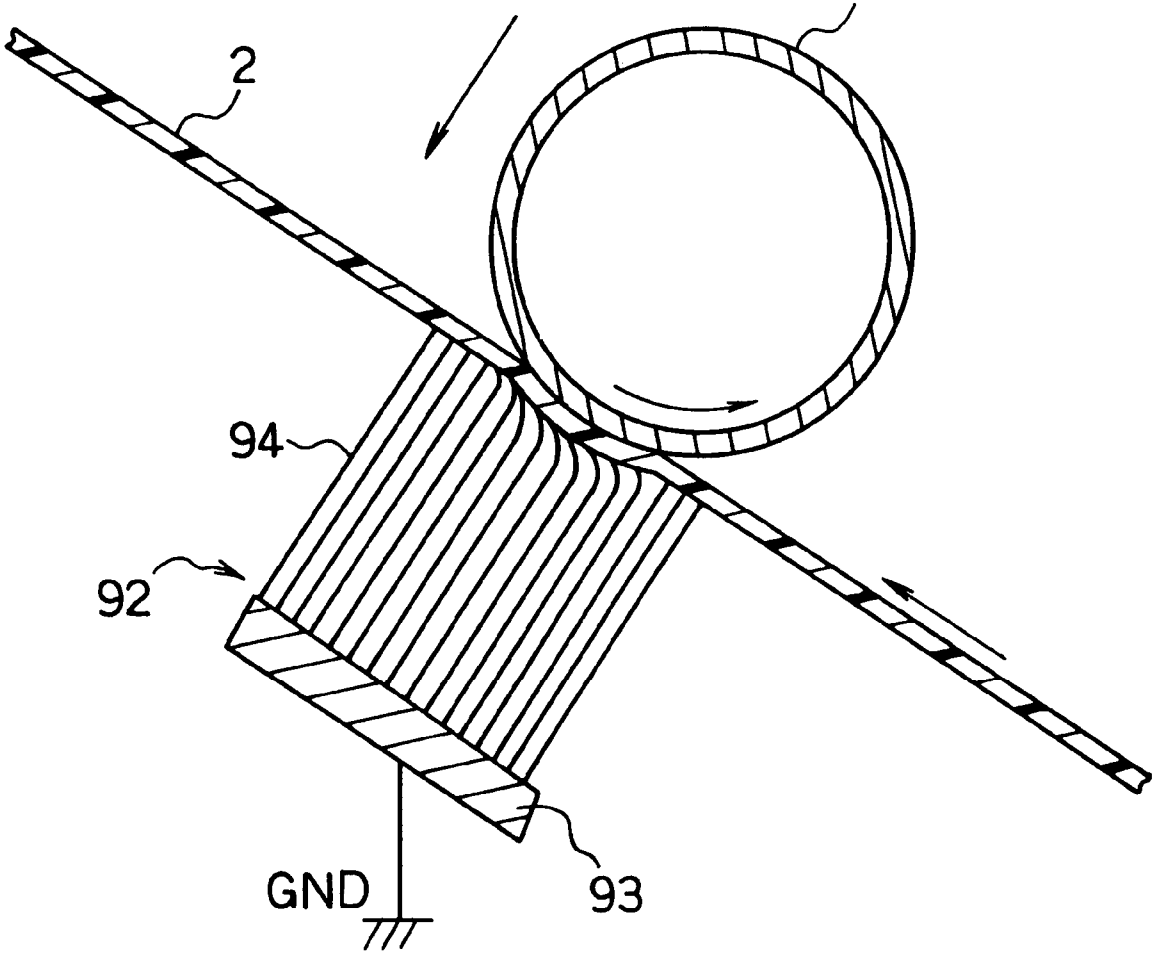
FIG. 12 is a side view showing the structure of a part where a cleaner roller is pressed in the fifth embodiment of the present invention.

FIG. 11 is a cross-sectional elevation view showing a color image forming apparatus according to a fifth embodiment. FIG. 12 is a cross-sectional elevation view showing a part where a cleaner roller 91 and the intermediate transfer belt 2 of this embodiment is in contact.

In FIG. 11, differences from the structure of FIG. 1 will be described.

The cleaner roller 91 comprises an aluminum pipe having an alumite layer with a thickness of 2 to 15 $\mu$m on the surface.

An opposed brush 92 as an opposed electrode member is disposed on the reverse surface of a part of the intermediate transfer belt 2 where the cleaner roller 91 is pressed against the transfer surface of the intermediate transfer belt 2. The opposed brush 92 comprises a conductive base plate 93 on which 6-denier semi-conductive rayon fibers 94 are planted at a density of $10^5$ fibers per one square inch. The brush fibers 94 of the opposed brush 92 is approximately 5 mm high and approximately 5 mm wide. The length in the direction vertical to the plane of the figure is approximately 220 mm. The resistance value when the opposed brush 92 is in contact with a metal plate at a pressure such that the height is reduced by 1 mm is $10^3$ to $10^6$ Ω. As the brush fibers, ones with thicknesses of 0.5 to 10 deniers can be used. If the brush fibers are too thick, variation in load torque caused when the cleaner roller 91 is pressed is large. If the brush fibers are too thin, the life of the opposed brush 92 is short. The planting density of the brush fibers can be selected from a range of $10^3$ to $10^6$ fibers per one square inch. It is desirable to reduce the planting density as the thickness of the brush fibers increases.

The drive roller 3 is disposed in the lower left direction of the tension roller 4 so that the transfer surface of the intermediate transfer belt 2 at the image formation position 44 faces in the upper left direction. The elements of the cleaner 6 including the cleaner roller 91 are disposed within a range enclosed by the intermediate transfer belt 2, the vertical tangential line 5A of the opposed roller 5, and the tangential line 4A of the tension roller 4 is parallel to the common tangential line of the opposed roller 5 and the drive roller 3.

The scraper 23 and the toner case 24 are disposed in the upper vicinity of the cleaner roller 91.

The angle at which the laser beam 66 exits from the exposure unit 65 is approximately 45 degrees to the horizontal in the upper left direction. The angle at which the laser beam 66 reflected at the mirror 67 is incident on the photoconductor 30 is approximately 10 degrees in the lower right direction. The fuser unit 51 and the belt unit 1 are situated lower than those of the first embodiment.

In accordance with the angle of incidence of the laser beam 66, the stop position of the carriage 41 for positioning the image forming units 29Y to 29Bk at the image formation position 44 is different from that shown in FIG. 1. In accordance with the difference of the position of the drive roller 3, the body-side gear 11 for driving the belt unit 1 is situated lower than that of FIG. 1.

In FIG. 12, the opposed brush 92 is disposed on the reverse surface of the intermediate transfer belt 2 and held at the GND potential. At the time of cleaning, the cleaner roller 91 is moved in the direction of the arrow and pressed against the intermediate transfer belt 2. When the cleaner roller 91 is pressed against the intermediate transfer belt 2, the intermediate transfer belt deflects downward, and the reverse surface thereof is pushed against the opposed brush 92. When the cleaner roller 91 is separated from the intermediate transfer belt 2, the opposed brush 92 is lightly in contact with the reverse surface of the intermediate transfer belt 2. However, since variation in torque supplied to the drive shaft of the intermediate transfer belt 2 due to the contact of the opposed brush 92 is not more than 300 gf-cm, the transportation of the intermediate transfer belt 2 is hardly affected. Positional displacement among the images of the four colors are negligible in practical use. In this embodiment, the potential of the cleaner roller 91 is set at 300 V.

Other structures and operations are similar to those of the first embodiment.

In the fifth embodiment, the opposed brush 92 is used as the opposed electrode of the cleaner roller 91. Compared with the case in which a sheet-form member shown in the fourth embodiment is used as the opposed electrode, the area of contact with the intermediate transfer belt is small. Consequently, the load variation caused when the cleaner roller 91 is separated and brought into contact can be further restrained, and excellent cleaning performance is maintained. For example, variation in load torque of the drive roller 3 of the intermediate transfer belt 2 can be restrained to 300 gf-cm or smaller. The elements of the cleaner 6 including the cleaner roller 91 are disposed within a range enclosed by the intermediate transfer belt 2, the vertical tangential line 5A of the opposed roller 5 at the secondary transfer position 20A, and the tangential line 4A of the tension roller 4 parallel to the common tangential line of the opposed roller 5 and the drive roller 3. Consequently, the belt unit 1 is trapezoidal, and no extreme projections and depressions are caused thereon, so that the volume of possession of the belt unit 1 in the apparatus body 40 decreases. By attaching and detaching the belt unit 1 from the direction of the common tangential line of the drive roller 3 and the opposed roller 5, the size of the front door 42 necessary for the attachment and detachment can be minimized, so that the apparatus body 40 can be reduced in size. Since the paper path 54 is substantially vertical at the secondary transfer position 20A, the structure is simplified, and the number of elements of the front door in the vicinity of the paper path 54 is reduced. Consequently, the apparatus body 40 can be reduced in size. Particularly, the front door 42 can be reduced in size and weight. Although it is desirable to dispose all the elements of the cleaner 6 within the above-mentioned range, similar effects are obtained by situating at least the central position of the cleaner roller 91 within the range.

By disposing the drive roller 3 below the tension roller 4 and setting the transfer surface of the intermediate transfer belt 2 at the image formation position 44 to face upward, the position of the photoconductor 30 at the image formation position in the apparatus body 40 is lowered. Since the attachment position of the belt unit 1 is lowered accordingly, the position of the fuser unit 51 can be lowered. Consequently, the overall height of the apparatus body 40 is reduced, and the front door 42 can be reduced in size and weight as mentioned above.

By disposing the scraper 23 and the toner case 24 in the upper vicinity of the cleaner roller 91, the toner case 24 can be situated above the waste toner case 7. Consequently, the conveyance path 26A by the screw 26 faces downward, so that toner can be smoothly conveyed to the waste toner case 7.

The positions of the drive roller 3 and the tension roller 4 are decided with reference to the image formation position on the photoconductor 30 and the position of the opposed roller 5. Excellent results are obtained by using as the drive roller the one of the driver roller 3 and the tension roller 4 other than the opposed roller 5 that the intermediate transfer belt 2 is turned along at a larger angle. By setting a large angle of turn of the intermediate transfer belt 2 along the drive roller 3, the frictional force increases, so that the drive force of the intermediate transfer belt 2 increases. Consequently, the speed difference of the intermediate transfer belt 2 due to the separation and contact of the cleaner roller 91 is reduced, so that the positional displacement among the images of the colors can be restrained. By reducing the angle of turn of the intermediate transfer belt 2 along the tension roller 4, the frictional force of the tension roller 4 can be reduced, so that the tension roller can be smoothly moved.

Although fibers where carbon is dispersed in rayon are used for the opposed brush 92, any conductive material may be used as long as its potential becomes constant when it is in contact with the reverse surface of the intermediate transfer belt 2. Examples thereof include fibers of nylon or polyester in which a conductive material is dispersed, thin metal fibers, and carbon fibers. The width, length and density of the opposed brush 92 are not limited to the above-mentioned examples but may be any width, length and density as long as the potential is held constant in the region where the cleaner roller 91 is pressed against the intermediate transfer belt 2.

Instead of a brush, a foaming material such as sponge may be used.

In the above-mentioned embodiments, although a color printer in which the cleaner roller is separated from and brought into contact with the intermediate transfer belt 2 is described as an example, the present invention is applicable to a black-and-white printer in which the separation and contact of the cleaner is not performed. By adding a scanner or a facsimile module, the present invention can be used as a copier or a facsimile.

As described above, according to the present invention, unnecessary toner on the intermediate transfer belt can be completely removed with a simple structure without the throughput and the positioning accuracy being deteriorated. The waste toner can be discharged out of the apparatus and toner is prevented from spilling inside and outside the apparatus, so that a color image forming apparatus excellent in maintainability can be realized.

Since operations such as replacement of the belt unit, removal of jammed paper, replenishment of recording paper and replacement of the intermediate transfer belt can all be performed from the front surface of the apparatus (right side surface of FIG. 1 and FIG. 11), maintenance is easy. Since the positioning accuracy of the toner images is high, a small-size color image forming apparatus in which high-quality images are obtained and the throughput is high can be realized.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

We claim:

1. A color image forming apparatus comprising:

a conductive intermediate transfer belt onto which images of charged toner of a plurality of colors are transferred so as to be superimposed;

a plurality of belt support shafts for rotatably supporting said intermediate transfer belt;

a cleaner roller energized at a first electrical potential opposite in polarity to a charge applied to the toner, said cleaner roller being brought into contact with said intermediate transfer belt in order to remove toner on said intermediate transfer belt and being separated from and brought into contact with said intermediate transfer belt when a toner image is being transferred onto said intermediate transfer belt;

collection means for removing toner from said cleaner roller;

separation and contact means for separating and bringing into contact said cleaner roller from and with said intermediate transfer belt; and an opposed electrode having a flexible member which is energized at a second electrical potential closer to the polarity of the charge of the toner than the first electrical potential of said cleaner roller said member being brought into contact with said intermediate transfer belt so as to oppose said cleaner roller.

2. A color image forming apparatus in accordance with claim 1, further comprising a waste toner case for storing toner removed by said cleaner roller, wherein said intermediate transfer belt, support shafts, said opposed electrode, said cleaner roller, said collection means and said waste toner case are formed as one belt unit, said belt unit is detachably attachable to the apparatus body of said image forming apparatus, and said cleaner roller is a roller of a conductive material having a highresistance layer on its surface.

3. A color image forming apparatus comprising:

a conductive intermediate transfer belt onto which images of charged toner of a plurality of colors are transferred so as to be superimposed;

a plurality of belt support shafts for rotatably supporting said intermediate transfer belt;

a cleaner roller energized at a first electrical potential opposite in polarity to a charge applied to the toner, said cleaner roller being brought into contact with said intermediate transfer belt in order to remove toner on said intermediate transfer belt, and variation in load torque of a drive shaft of said intermediate transfer belt being not more than 300 gf-cm, when said cleaner roller is separated from and brought into contact with said intermediate transfer belt;

collection means for removing toner from said cleaner roller;

separation and contact means for separating and bringing into contact said cleaner roller from and with said intermediate transfer belt; and an opposed electrode having a flexible member which is energized at a second electrical potential closer to the polarity of the charge of the toner than the first electrical potential of said cleaner roller, said member being brought into contact with said intermediate transfer belt so as to oppose said cleaner roller.

4. A color image forming apparatus comprising:

a conductive intermediate transfer belt onto which images of charged toner of a plurality of colors are transferred so as to be superimposed;

a plurality of belt support shafts for rotatably supporting said intermediate transfer belt;

a cleaner roller energized at a first electrical potential opposite in polarity to a charge applied to the toner, said cleaner roller being brought into contact with said intermediate transfer belt in order to remove toner on said intermediate transfer belt;

collection means for removing toner from said cleaner roller;

separation and contact means for separating and bringing into contact said cleaner roller from and with said intermediate transfer belt; and an opposed electrode having a flexible member which is energized at a second electrical potential closer to the polarity of the charge of the toner than the first electrical potential of said cleaner roller, said member being brought into contact with said intermediate transfer belt so as to oppose to said cleaner roller, said opposed electrode being a conductive brush planted on a conductive base plate, and a resistance value between said conductive base plate and a metal plate is $10^3$ to $10^6$ ohms when said conductive brush in which brush fibers are 5 mm long and a planting area on said conductive base plate is 1100 $mm^2$ is in contact with said metal plate with a force that warps the brush fibers by 1 mm.

5. A color image forming apparatus comprising:

a conductive intermediate transfer belt onto which images of charged toner of a plurality of colors are transferred so as to be superimposed;

a plurality of belt support shafts for rotatable supporting said intermediate transfer belt;

a cleaner roller energized at a first electrical potential opposite in polarity to a charge applied to the toner, said cleaner roller being brought into contact with said intermediate transfer belt in order to remove toner on said intermediate transfer belt;

collection means for removing toner from said cleaner roller;

separation and contact means for separating and bringing into contact said cleaner roller from and with said intermediate transfer belt; and an opposed electrode having a flexible member on a surface thereof which is energized at a second electrical potential closer to the polarity of the charge of the toner than the first electrical potential of said cleaner roller, said member being brought into contact with said intermediate transfer belt so as to oppose to said cleaner roller, and said opposed electrode being a sheet-form member, and a backup member for pressing said opposed electrode against said intermediate transfer belt with elasticity being further provided.

6. A color image forming apparatus in accordance with claim 5, wherein said backup member is concave at a part opposed to a central part of said intermediate transfer belt against which the cleaner roller is pressed.

7. A color image forming apparatus comprising:

a conductive intermediate transfer belt onto which images of charged toner of a plurality of colors are transferred so as to be superimposed;

a plurality of belt support shafts for rotatably supporting said intermediate transfer belt;

a cleaner roller energized at a first electrical potential opposite in polarity to a charge applied to the toner, said cleaner roller being brought into contact with said intermediate transfer belt in order to remove toner on said intermediate transfer belt, and said cleaner roller being a metal roller having a high-resistance layer formed on its surface by chemical change of said metal, and having a resistance in the range of which the surface is the substantially same potential as that of a base member, collection means for removing, toner from said cleaner roller;

separation and contact means for separating and bringing into contact said cleaner roller from and with said intermediate transfer belt; and an opposed electrode having a flexible member energized at a second electrical potential closer to the polarity of the charge of the toner than the first electrical potential of said cleaner roller, said member being brought into contact with said intermediate transfer belt so as to oppose said cleaner roller.

8. A color image forming apparatus in accordance with claim 7, wherein said opposed electrode is a conductive brush planted on a conductive base plate.

9. A color image forming apparatus in accordance with claim 7, wherein said cleaner roller is a roller made of aluminum and having an alumite layer on its surface.

10. A color image forming apparatus comprising:

a conductive intermediate transfer belt onto which images of charged toner of a plurality of colors are transferred so as to be superimposed;

a plurality of belt support shafts for rotatably supporting said intermediate transfer belt;

a cleaner roller energized at a first electrical potential opposite in polarity to a charge applied to the toner, said cleaner roller being brought into contact with said intermediate transfer belt at a position between said belt support shafts, the shafts being energized at different potentials from each other in order to remove toner on said intermediate transfer belt, collection means for removing toner from said cleaner roller;

separation and contact means for separating and bringing into contact said cleaner roller from and with said intermediate transfer belt; and an opposed electrode comprising a flexible member energized at a second electrical potential closer to the polarity of the charge of the toner than the first electrical potential of said cleaner roller, said member being brought into contact with said intermediate transfer belt so as to oppose to said cleaner roller, wherein electrical potentials of two belt support shafts adjacent to a cleaning position where said cleaner roller is pressed against said intermediate transfer belt are different from each other.

11. A belt unit having the following formed in one unit:

an intermediate transfer belt onto which images of charged toner of a plurality of colors are transferred so as to be superimposed;

a plurality of belt support shafts for rotatably supporting said intermediate transfer belt;

a cleaner roller energized at a first electrical potential opposite in polarity to a charge applied to the toner, said cleaner roller being brought into contact with said intermediate transfer belt in order to remove toner on said intermediate transfer belt and said cleaner roller being a metal roller having a high-resistance layer formed on its surface by chemical chance of said metal;

collection means for removing toner from said cleaner roller;

separation and contact means for separating and bringing into contact said cleaner roller from and with said intermediate transfer belt; and an opposed electrode energized at a second electrical potential closer to the polarity of the charge of the toner than the first electrical potential of said cleaner roller, said opposed electrode having flexibility and being brought into contact with said intermediate transfer belt so as to be opposed to said cleaner roller.

12. A color image forming apparatus comprising:

a cleaner roller energized at a predetermined potential opposite in polarity to a charge applied to toner in order to remove toner on an intermediate transfer belt onto which images of charged toner of a plurality of colors are transferred so as to be superimposed;

a collection roller for removing toner from said cleaner roller;

a scraper for scraping toner from said collection roller;

a waste toner case for storing toner removed from said cleaner roller; and a seal member for preventing toner from spilling through a gap between said collection roller, and said scraper and said waster toner case, said seal member being fixed on a cleaner unit wherein said cleaner roller, said collection roller, said scraper, said waste toner case and said seal member are formed as one cleaner unit so as to be detachably attachable to a body of said color image forming apparatus in a direction vertical to an axis of said cleaner roller.

13. A color image forming apparatus comprising:

a cleaner roller energized at a predetermined potential opposite in polarity to a charge applied to toner in order to remove toner on an intermediate transfer belt onto which charged toner images of a plurality of colors are transferred so as to be superimposed;

a collection roller for removing toner from said cleaner roller;

a scraper for scraping toner from said collection roller;

a waste toner case for storing toner removed from said cleaner roller; and a seal member for preventing toner from spilling through a gap of said waste toner case, said seal member being fixed on a cleaner unit wherein said collection roller, said scraper, said waste toner case and said seal member are formed as one cleaner unit so as to be detachably attachable to a body of said color image forming apparatus in a direction vertical to an axis of said cleaner roller.

14. A color image forming, apparatus comprising:

a cleaner roller for removing toner on an intermediate transfer belt onto which charged toner images of a plurality of colors are transferred so as to be superimposed;

a scraper pressed against said cleaner roller for scraping toner;

a waste toner case for storing toner removed from said cleaner roller; and a seal member for preventing toner from spilling through a gap between said collection roller, and said scraper and said waste toner case, said seal member being fixed on a cleaner unit wherein said cleaner roller, said scraper, said waste toner case and said seal member are formed as one cleaner unit so as to be detachably attachable to a body of said image forming apparatus in a direction vertical to an axis of said cleaner roller.

15. A color image forming apparatus having a belt unit being detachably attachable in said color image forming apparatus, said belt unit comprising:

an intermediate transfer belt for transferring onto recording paper a color image formed by primary-transferring images of toner of a plurality of colors so as to be superimposed;

a first support shaft, a second support shaft and a third support shaft for supporting said intermediate transfer belt; and a cleaner roller for removing toner, said cleaner roller being separated from and brought into contact with said intermediate transfer belt at a part of said intermediate transfer belt stretching between said first support shaft and said third support shaft, wherein said cleaner roller is disposed so that its center is situated within a range enclosed by said intermediate transfer belt, a tangential line of said first support shaft parallel to a common tangential line of peripheries of said second support shaft and said third support shaft, and a tangential line of said third support shaft parallel to a common tangential line of peripheries of said first support shaft and said second support shaft, a part of said intermediate transfer belt stretching between said first support shaft and said second support shaft is set as a part where said primary transfer is performed, and the common tangential line of the peripheries of said second support shaft and said third support shaft is substantially horizontal.

16. A color image forming apparatus having a belt unit in which the following are formed in one unit: an intermediate transfer belt for secondary-transferring onto recording sheet a color image formed by primary-transferring images of toner of a plurality of colors so as to be superimposed; a first support shaft, a second support shaft and a third support shaft for supporting said intermediate transfer belt, and a cleaner roller separated from and brought into contact with said intermediate transfer belt in order to remove toner, said belt unit being detachably attachable in said color image forming apparatus with said third support shaft on an operator's side, wherein said cleaner roller is disposed within a range enclosed by said intermediate transfer belt, a tangential line of said first support shaft parallel to a common tangential line of peripheries of said second support shaft and said third support shaft, and a vertical tangential line on a secondary transfer side of said third support shaft, primary transfer is performed at a part of said intermediate transfer belt stretching between said first support shaft and said second support shaft, and cleaning is performed at a part of said intermediate transfer belt stretching between said third support shaft and said first support shaft adjoining said third support shaft in a downstream side in a rotation direction thereof;

secondary transfer is performed in a vicinity of a point of contact of a vertical tangential line of said second support shaft, and the common tangential line of the peripheries of said second support shaft and said third support shaft is substantially horizontal.

17. A color image forming apparatus in accordance with claim 16, comprising:

recording paper feed means situated in a lower part of said color image forming apparatus;

a plurality of process units each having a developer unit containing toner of a different color and a photoconductor for forming an image of toner, said process units being detachable and attachable from an upper surface of said color image forming apparatus;

exposure means for performing scan and exposing said photoconductor; and fusing means for fusing the image of toner on recording paper, wherein said exposure means is situated below said belt unit, said fusing means is situated above said belt unit, a secondary transfer position is situated farther forward than a primary transfer position in a body of said apparatus, and said belt unit becomes detachable and attachable by opening a front door having elements disposed farther forward than a recording paper conveyance path, and the common tangential line of the peripheries of said second support shaft and said third support shaft is substantially horizontal.

18. A color image forming apparatus having a belt unit in which the following are formed in one unit: an intermediate transfer belt onto which images of toner of a plurality of colors are transferred so as to be superimposed; a cleaner roller for removing toner on an upward-facing peripheral surface of said intermediate transfer belt; and three belt support rollers for supporting said intermediate transfer belt, said three belt support rollers including an opposed roller, said belt unit being formed so as to be detachably attachable in said color image forming apparatus with said opposed roller on an operator's side, wherein said three belt support rollers are a tension roller for maintaining tension of said intermediate transfer belt constant, the opposed roller for secondary transfer and a drive roller for rotating said intermediate transfer belt, primary transfer is performed at a part of said intermediate transfer belt stretching between said drive roller and said tension roller, cleaning is performed at a part of said intermediate transfer belt stretching between said opposed roller and the support shaft adjoining said opposed roller in a downstream side, and a common tangential line of said opposed roller and said support roller adjoining said opposed roller in an upstream side is substantially horizontal.

19. A color image forming apparatus in accordance with claim 18, wherein a direction of attachment and detachment of said belt unit is parallel to a common tangential line of said opposed roller and said three belt support rollers adjoining said opposed roller in an upstream side of said intermediate transfer belt in a rotation direction thereof.

20. A color image forming apparatus in accordance with claim 18, comprising:

recording paper feed means situated in a lower part of said color image forming apparatus;

a plurality of process units each having a developer unit containing toner of a different color and a photoconductor for forming an image of toner, said process units being detachable and attachable from an upper surface of said color image forming apparatus;

exposure means for performing scan and exposing said photoconductor; and fusing means for fusing a toner image on recording paper, wherein said exposure means is situated below said belt unit, said fusing means is situated above said belt unit, a secondary transfer position is situated farther forward than a primary transfer position in a body of said apparatus, and said belt unit becomes detachable and attachable by opening a front door having elements disposed farther forward than a recording paper conveyance path.

21. A color image forming apparatus having a belt unit in which the following are formed in one unit: an intermediate transfer belt onto which images of toner of a plurality of colors are transferred so as to be superimposed; a cleaner roller for removing toner on an upward-facing peripheral surface of said intermediate transfer belt; and three belt support rollers for supporting said intermediate transfer belt, said three belt support rollers including an opposed roller, said belt unit being, formed so as to be detachably attachable in said color image forming apparatus with said opposed roller on an operator's side, wherein said three belt support rollers are a tension roller for maintaining, tension of said intermediate transfer belt constant, the opposed roller for secondary transfer and a drive roller for rotating said intermediate transfer belt, primary transfer is performed at a part of said intermediate transfer belt stretching between said drive roller and said tension roller, cleaning is performed at a part of said intermediate transfer belt stretching between said opposed roller and the support shaft adjoining said opposed roller in a downstream side, and said drive roller has a drive gear meshing with a gear of a body of said apparatus, and said drive roller is situated at a position closer to the body of said apparatus than to said cleaner roller when said belt unit is attached to the body of said apparatus.

22. A color image forming apparatus having a belt unit in which the following are formed in one unit: an intermediate transfer belt onto which images of toner of a plurality of colors are transferred so as to be superimposed; a cleaner roller for removing toner on an upward-facing peripheral surface of said intermediate transfer belt; and three belt support rollers for supporting said intermediate transfer belt, said three belt support rollers including an opposed roller, said belt unit being formed so as to be detachably attachable in said color image forming apparatus with said opposed roller on an operator's side, wherein said three belt support rollers are a tension roller for maintaining tension of said intermediate transfer belt constant, the opposed roller for secondary transfer and a drive roller for rotating said intermediate transfer belt, primary transfer is performed at a part of said intermediate transfer belt stretching between said drive roller and said tension roller, cleaning is performed at a part of said intermediate transfer belt stretching between said opposed roller and the support shaft adjoining said opposed roller in a downstream side, and said belt unit has a positioning member for positioning relative to a body of said apparatus, said positioning member being formed coaxially with said driver roller.

* * * * *